US011297898B2

(12) United States Patent
Dolan et al.

(10) Patent No.: US 11,297,898 B2
(45) **Date of Patent: *Apr. 12, 2022**

(54) ARTICLE OF FOOTWEAR HAVING A SOLE STRUCTURE WITH A FLUID-FILLED CHAMBER

(71) Applicant: NIKE, Inc., Beaverton, OR (US)

(72) Inventors: Robert W. Dolan, Portland, OR (US); Travis K. Ernst, Portland, OR (US); Scott C. Holt, Portland, OR (US); Lisa M. Hovey, Portland, OR (US); Eric S. Schindler, Beaverton, OR (US); Tamimu A. Shyllon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 393 days.

This patent is subject to a terminal disclaimer.

(21) Appl. No.: 15/454,854

(22) Filed: Mar. 9, 2017

(65) Prior Publication Data

US 2017/0172250 A1 Jun. 22, 2017

Related U.S. Application Data

(63) Continuation of application No. 13/428,756, filed on Mar. 23, 2012, now Pat. No. 9,609,912.

(51) Int. Cl.
*A43B 13/18* (2006.01)
*A43B 13/20* (2006.01)
(Continued)

(52) U.S. Cl.
CPC ..... *A43B 13/203* (2013.01); *A43B 13/122* (2013.01); *A43B 13/125* (2013.01);
(Continued)

(58) Field of Classification Search
CPC ... A43B 13/181; A43B 13/185; A43B 13/189; A43B 13/20; A43B 13/203;
(Continued)

(56) References Cited

U.S. PATENT DOCUMENTS 500,385 A 6/1893 Hall
2,155,166 A 4/1939 Kraft
(Continued)

FOREIGN PATENT DOCUMENTS

EP 1002475 A1 5/2000
GB 2340378 A 2/2000
(Continued)

OTHER PUBLICATIONS

State Intellectual Property Office (PRC), Office Action for CN Application No. 201710145523.9, dated May 28, 2018.
(Continued)

*Primary Examiner* — Katharine G Kane

(74) *Attorney, Agent, or Firm* — Honigman LLP; Matthew H. Szalach; Jonathan O'Brien

(57) ABSTRACT

An article of footwear has an upper and a sole structure secured to the upper. The sole structure includes a chamber that encloses a pressurized fluid. The chamber includes subchambers laterally extending in a medial to lateral direction of the bladder. A bottom surface of the chamber may include at least one bond that laterally extends across the bottom surface of the chamber from one side edge to another side edge of the chamber in the medial to lateral direction. The bond may cooperate with an indentation in the bottom surface that separates one subchamber from an adjacent subchamber. A diameter of the subchambers may decrease in a direction from a heel region of the bladder to a forefoot region of the chamber.

16 Claims, 20 Drawing Sheets

(51) Int. Cl.
*A43B 13/12* (2006.01)
*A43B 13/22* (2006.01)
*A43B 13/14* (2006.01)

(52) U.S. Cl.
CPC ..... *A43B 13/141* (2013.01); *A43B 13/186* (2013.01); *A43B 13/188* (2013.01); *A43B 13/20* (2013.01); *A43B 13/206* (2013.01); *A43B 13/223* (2013.01)

(58) Field of Classification Search
CPC ... A43B 13/206; A43B 13/223; A43B 17/026; A43B 17/03; A43B 17/035
USPC ..... 36/28, 29, 35 R, 35 B, 37
See application file for complete search history.

(56) References Cited

U.S. PATENT DOCUMENTS 2,188,168 A 1/1940 Mabel
2,224,590 A 12/1940 Odilon
3,087,261 A 4/1963 Russell
3,683,431 A 8/1972 Pennel et al.
3,795,994 A 3/1974 Ava
4,059,910 A 11/1977 Bryden et al.
4,130,947 A 12/1978 Denu
4,183,156 A 1/1980 Rudy
4,217,705 A 8/1980 Donzis
4,219,945 A 9/1980 Rudy
4,241,524 A 12/1980 Sink
4,265,032 A 5/1981 Levine
4,287,250 A 9/1981 Rudy
4,302,892 A 12/1981 Adamik
4,309,831 A 1/1982 Pritt
4,309,832 A 1/1982 Hunt
4,340,626 A 7/1982 Rudy
4,547,978 A 10/1985 Radford
4,638,577 A 1/1987 Riggs
D288,027 S 2/1987 Tonkel
D294,537 S 3/1988 Le
D294,653 S 3/1988 Le
4,906,502 A 3/1990 Rudy
4,908,964 A 3/1990 Deem
4,936,029 A 6/1990 Rudy
5,042,176 A 8/1991 Rudy
5,083,361 A 1/1992 Rudy
5,313,717 A * 5/1994 Allen ..... A43B 13/20 36/28
D351,056 S * 10/1994 Auger ..... D2/961
5,425,184 A 6/1995 Lyden et al.
D374,761 S * 10/1996 Sell, Jr. ..... D2/961
5,572,804 A 11/1996 Skaja et al.
D378,472 S 3/1997 Bramani
5,625,964 A 5/1997 Lyden et al.
5,686,167 A 11/1997 Rudy
5,713,141 A 2/1998 Mitchell et al.
D396,342 S 7/1998 Foxen et al.
5,784,808 A 7/1998 Hockerson
5,794,359 A 8/1998 Jenkins et al.
5,915,820 A 6/1999 Kraeuter et al.
5,952,065 A 9/1999 Mitchell et al.
5,976,451 A 11/1999 Skaja et al.
5,987,781 A 11/1999 Paves et al.
5,993,585 A 11/1999 Goodwin et al.
6,009,637 A 1/2000 Pavone
6,013,340 A 1/2000 Bonk et al.
6,029,962 A 2/2000 Shorten et al.
D421,832 S 3/2000 Loveder
6,065,230 A 5/2000 James
6,079,126 A 6/2000 Olszewski
6,082,025 A 7/2000 Bonk et al.
6,098,313 A 8/2000 Skaja
6,115,945 A 9/2000 Ellis, III
6,119,371 A 9/2000 Goodwin et al.
6,127,026 A 10/2000 Bonk et al.
6,178,663 B1 1/2001 Schoesler
6,203,868 B1 3/2001 Bonk et al.
6,205,682 B1 3/2001 Park
6,321,465 B1 11/2001 Bonk et al.
6,487,795 B1 12/2002 Ellis, III
6,900,755 B2 5/2005 Richardson et al.
D512,818 S 12/2005 Mitani et al.
7,141,131 B2 11/2006 Foxen et al.
7,168,190 B1 1/2007 Gillespie
7,386,946 B2 6/2008 Goodwin
7,448,150 B1 * 11/2008 Davis ..... A43B 13/203 36/153
7,555,848 B2 7/2009 Aveni et al.
7,562,469 B2 * 7/2009 Dojan ..... A43B 13/20 36/29
7,665,230 B2 2/2010 Dojan et al.
7,917,981 B1 * 4/2011 Lakic ..... A43B 7/24 12/142 R
2002/0121031 A1 9/2002 Smith et al.
2003/0046830 A1 3/2003 Ellis
2003/0097767 A1 5/2003 Perkinson
2003/0183324 A1 10/2003 Tawney et al.
2005/0076536 A1 4/2005 Hatfield et al.
2005/0097777 A1 5/2005 Goodwin
2005/0132609 A1 6/2005 Dojan et al.
2005/0133968 A1 6/2005 Foxen et al.
2007/0169379 A1 7/2007 Hazenberg et al.
2009/0151195 A1 6/2009 Forstrom et al.
2009/0178300 A1 7/2009 Parker
2013/0232821 A1 * 9/2013 Schindler ..... A43B 13/141 36/103

FOREIGN PATENT DOCUMENTS

JP S54500089 A 12/1979
JP H0333523 A 2/1991
JP 2007516046 A 6/2007
KR 20040053201 A 6/2004
WO WO-9103180 A1 3/1991
WO WO-9105491 A1 5/1991
WO WO-9111924 A1 8/1991
WO WO-9119429 A1 12/1991
WO WO-9207483 A1 5/1992
WO WO-9403080 A1 2/1994
WO 2011142905 A1 11/2011

OTHER PUBLICATIONS

Korean Intellectual Property Office, Office Action for KR Application No. 10-2017-7021001, dated Feb. 20, 2018.
Korean Intellectual Property Office, Office Action for KR Application No. 10-2018-7030656, dated Nov. 20, 2018.
Korea Intellectual Property Office, Korean Office Action for Application No. 10-2014-7029549, dated Jan. 21, 2016.
Japan Patent Office, Japanese Office Action for Application No. 2015-501904, dated Jan. 20, 2016.
International Search Report and Written Opinion dated Dec. 2, 2013 cited in PCT/US2013/033231.
Invitation to Pay Additional Fees and Where Applicable, Protest Fee (with Search Report) dated Sep. 11, 2013, cited in PCT/US2013/033231.
USPTO, Final Office Action for U.S. Appl. No. 13/428,756, dated Aug. 2, 2016.
USPTO, Non-Final Office Action for U.S. Appl. No. 13/428,756, dated Feb. 11, 2016.
USPTO, Final Office Action for U.S. Appl. No. 13/428,756, dated Sep. 18, 2015.
USPTO, Non-Final Office Action for U.S. Appl. No. 13/428,756, dated Apr. 6, 2015.
USPTO, Final Office Action for U.S. Appl. No. 13/428,756, dated Sep. 10, 2014.
USPTO, Non-Final Office Action for U.S. Appl. No. 13/428,756, dated Mar. 12, 2014.
European Patent Office, Extended European Search Report pursuant to Rule 62 EPC for EP Application No. 17001587.9, dated Feb. 13, 2018.

(56) References Cited

OTHER PUBLICATIONS

European Patent Office, Office Action for EP Application No. 17001587.9, dated Feb. 15, 2019.
Korean Intellectual Property Office, Notice of Allowance for KR Application No. 10-2018-7030656, dated May 29, 2019.
European Patent Office, Extended European Search Report for EP Application No. 20164773.2, dated May 13, 2020.

* cited by examiner

ARTICLE OF FOOTWEAR HAVING A SOLE STRUCTURE WITH A FLUID-FILLED CHAMBER

CROSS-REFERENCE TO RELATED APPLICATIONS

This application is a continuation of U.S. patent application Ser. No. 13/428,756, filed on Mar. 23, 2012, the disclosure of which is incorporated herein by reference in its entity.

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

One manner of reducing the weight of a polymer foam midsole and decreasing the effects of deterioration following repeated compressions is disclosed in U.S. Pat. No. 4,183,156 to Rudy, hereby incorporated by reference, in which ground reaction force attenuation is provided by a fluid-filled bladder formed of an elastomeric materials. The bladder includes a plurality of tubular chambers that extend longitudinally along a length of the sole structure. The chambers are in fluid communication with each other and jointly extend across the width of the footwear. The bladder may be encapsulated in a polymer foam material, as disclosed in U.S. Pat. No. 4,219,945 to Rudy, hereby incorporated by reference. The combination of the bladder and the encapsulating polymer foam material functions as a midsole. Accordingly, the upper is attached to the upper surface of the polymer foam material and an outsole or tread member is affixed to the lower surface. Bladders of the type discussed above are generally formed of an elastomeric material and are structured to have an upper and lower portions that enclose one or more chambers therebetween. The chambers are pressurized above ambient pressure by inserting a nozzle or needle connected to a fluid pressure source into a fill inlet formed in the bladder. Following pressurization of the chambers, the fill inlet is sealed and the nozzle is removed.

Fluid-filled bladders suitable for footwear applications may be manufactured by a two-film technique, in which two separate polymer sheets are bonded together to form a periphery of a bladder, and the sheets are also bonded together at predetermined interior areas to give the bladder a desired configuration. That is, the interior bonds provide the bladder with chambers having a predetermined shape and size. In another method, often referred to as thermoforming, two separate polymer sheets are heated, molded to a predetermined shape, and bonded together to form a periphery and interior bonds of the bladder. Such bladders have also been manufactured by a blow-molding technique, wherein a molten or otherwise softened elastomeric material in the shape of a tube is placed in a mold having the desired overall shape and configuration of the bladder. The mold has an opening at one location through which pressurized air is provided. The pressurized air induces the liquefied elastomeric material to conform to the shape of the inner surfaces of the mold. The elastomeric material then cools, thereby forming a bladder with the desired shape and configuration.

SUMMARY

According to one configuration, an article of footwear has an upper and a sole structure secured to the upper. The sole structure includes a chamber that encloses a pressurized fluid. The chamber has a first surface, a second surface, and a sidewall surface. The first surface is oriented to face toward upper, the second surface is located opposite the first surface and oriented to face away from the upper, and the sidewall surface extends between the first surface and the second surface and around at least a portion of the chamber. The first surface and the second surface define a plurality of elongated subchambers oriented in a direction that extends between a lateral side of the footwear and an opposite medial side of the footwear. The first surface and the second surface are joined to each other between at least two of the subchambers to form a bond oriented in the direction that extends between the lateral side of the footwear and the medial side of the footwear. End areas of the bond are spaced from the sidewall surface. The second surface defines an indentation at the bond, the indentation extending past the ends areas of the bond such that the indentation extends entirely across the chamber and from a portion of the sidewall surface located on the lateral side of the footwear to a portion of the sidewall surface located on the medial side of the footwear.

According to another configuration, an article of footwear has an upper and a sole structure secured to the upper. The sole structure includes a chamber that encloses a pressurized fluid. The chamber includes a plurality of tubes oriented in a direction that extends between a lateral side of the footwear and an opposite medial side of the footwear. A diameter of the tubes decreases in a direction from a heel region of the chamber to a forefoot region of the bladder.

According to a further configuration, an article of footwear includes an upper and a sole structure secured to the upper. The sole structure includes a chamber that encloses a pressurized fluid. The chamber includes subchambers laterally extending in a direction that extends between a lateral side of the footwear and an opposite medial side of the footwear. A bottom surface of the chamber includes at least one bond that extends in the direction that extends between the lateral side of the footwear and the medial side of the footwear. The bond forming an indentation in the bottom surface that separates one subchamber from an adjacent subchamber. An outsole defines a ground engaging surface that forms a plurality of outwardly-projecting ground engaging members, with the outsole extending into the indentation. The outsole includes a first area including the ground engaging members and a second area located where the outsole extends into the indentation, wherein the ground engaging members are absent from the second area.

According to yet another configuration, an article of footwear has an upper and a sole structure secured to the upper. The sole structure includes a chamber that encloses a pressurized fluid. The chamber includes a plurality of subchambers oriented in a direction that extends between a lateral side of the footwear and an opposite medial side of the footwear. A cross-sectional size of the subchambers decreases in a direction from a heel region of the chamber to a forefoot region of the chamber.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of an article of footwear. Although the footwear is disclosed as having a configuration that is suitable for running, concepts associated with the footwear may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the footwear may also be utilized with footwear styles that are generally considered to be non-athletic, including dress shoes, loafers, and sandals. Accordingly, the concepts disclosed herein may be utilized with a variety of footwear styles.

General Footwear Structure

Figure 1:
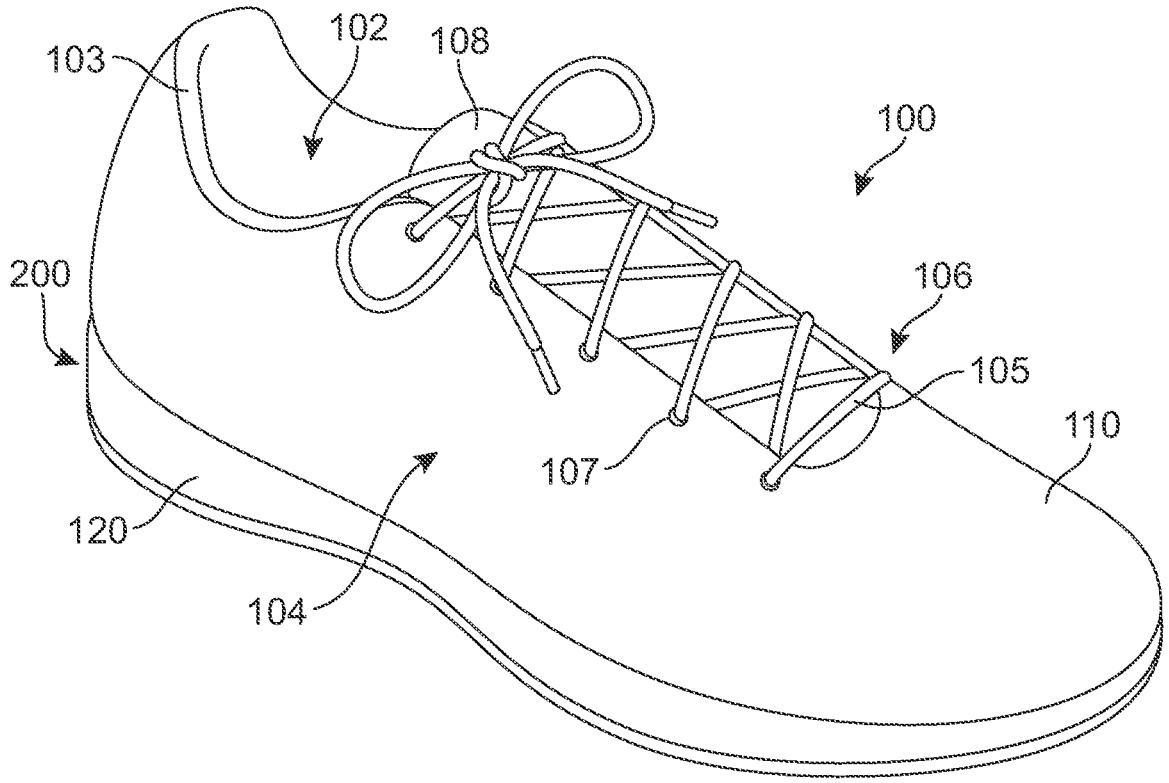
FIG. 1 is a perspective view of an article of footwear.
Figure 2:
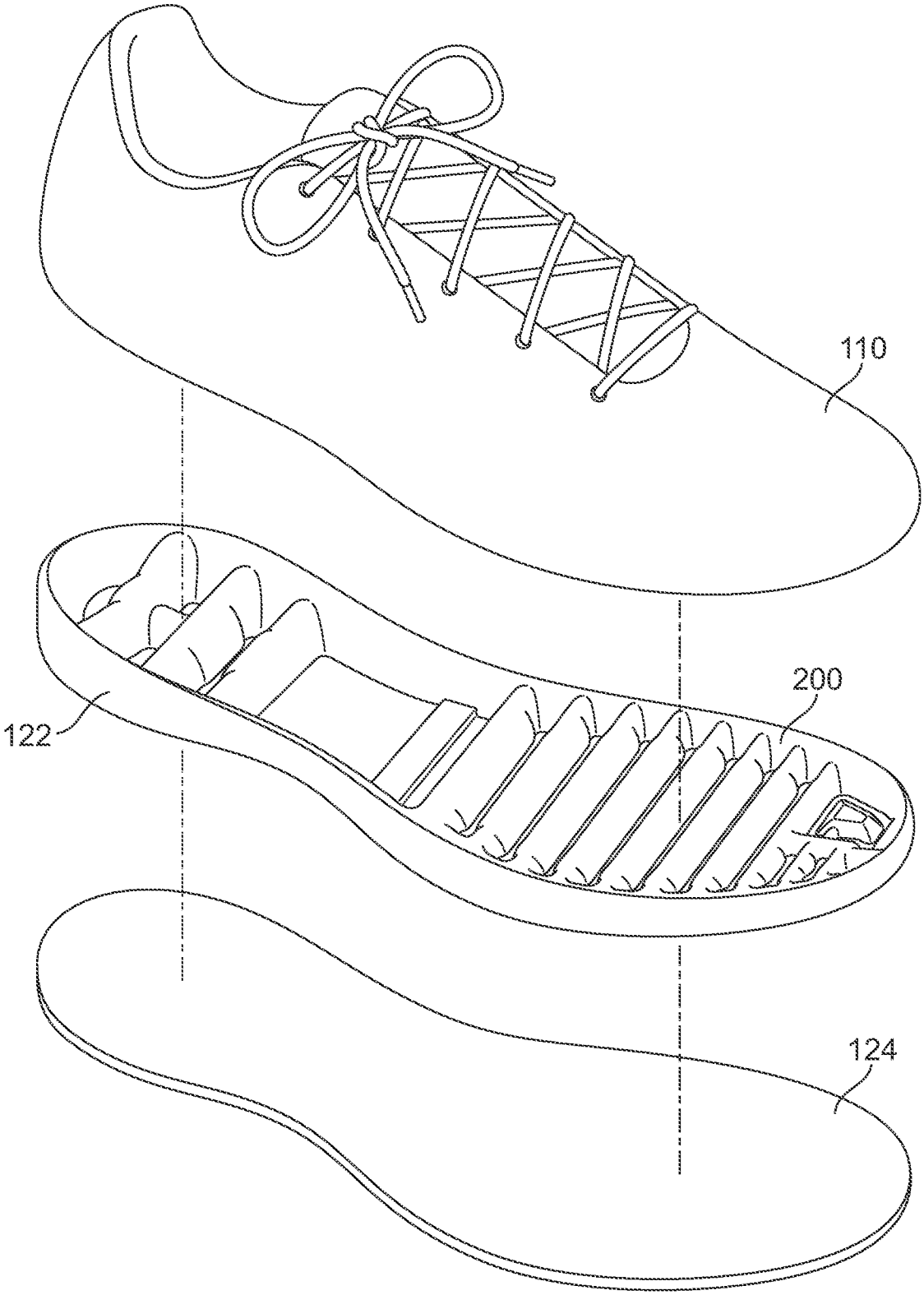
FIG. 2 is an exploded perspective view of the article of footwear.

An article of footwear 100 is depicted in FIGS. 1 and 2 as including an upper 110 and a sole structure 120. Upper 110 provides a comfortable and secure covering for a foot of a wearer. As such, the foot may be located within upper 110 to effectively secure the foot within footwear 100. Sole structure 120 is secured to a lower area of upper 110 and extends between upper 110 and the ground. When the foot is located within upper 110, sole structure 120 extends under the foot to attenuate ground reaction forces (i.e., cushion the foot), provide traction, enhance stability, and influence the motions of the foot, for example.

Upper 110 is depicted as having a substantially conventional configuration formed from a variety of elements (e.g., textiles, polymer sheet layers, polymer foam layers, leather, synthetic leather) that are stitched, bonded, or otherwise joined together to provide a structure for receiving and securing the foot relative to sole structure 120. The various elements of upper 110 define a void 102, which is a generally hollow area of footwear 100 with a shape of the foot, that is intended to receive the foot. As such, upper 110 extends along the lateral side 104 of the foot, along the medial side 106 of the foot, over the foot, around a heel of the foot, and under the foot. Access to void 102 is provided by an ankle opening 103 located in at least the heel of the footwear 100. A lace 105 extends through various lace apertures 107 and permits the wearer to modify dimensions of upper 110 to accommodate the proportions of the foot. More particularly, lace 105 permits the wearer to tighten upper 110 around the foot, and lace 105 permits the wearer to loosen upper 110 to facilitate entry and removal of the foot from void 102 (i.e., through ankle opening 103). As an alternative to lace apertures 107, upper 110 may include other lace-receiving elements, such as loops, eyelets, hooks, and D-rings. In addition, upper 110 includes a tongue 108 that extends between void 102 and lace 105 to enhance the comfort and adjustability of footwear 100. In some configurations, upper 110 may incorporate other elements, such as reinforcing members, aesthetic features, a heel counter that limits heel movement in the heel of the footwear, a wear-resistant toe guard located in the forefoot of the footwear, or indicia (e.g., a trademark) identifying the manufacturer. Accordingly, upper 110 is formed from a variety of elements that form a structure for receiving and securing the foot.

Turning to FIG. 2, the primary elements of sole structure 120 are a midsole 122 and an outsole 124. Midsole 122 may include, for example, a sealed fluid-filled chamber 200, which will be discussed below, and encloses a pressurized or unpressurized fluid. Although not depicted, midsole 122 may also include, for example, a polymer foam material, such as polyurethane or ethylvinylacetate, that is located above and/or below chamber 200. In addition to the fluid-filled chamber 200 and the polymer foam material, midsole 122 may incorporate one or more additional footwear elements that enhance the comfort, performance, or ground reaction force attenuation properties of footwear 100, including plates, moderators, lasting elements, or motion control members, for example. Although absent in some configurations, outsole 124 is secured to a lower surface of midsole 122 and may be formed from a rubber material that provides a durable and wear-resistant surface for engaging the ground. In addition, outsole 122 may be textured to enhance the traction (i.e., friction) properties between footwear 100 and the ground. The sole structure 120 may further include a sockliner (not shown), which is a compressible member located within void 102 and adjacent a lower surface of the foot to enhance the comfort of footwear 100.

Chamber Configuration

Figure 3:
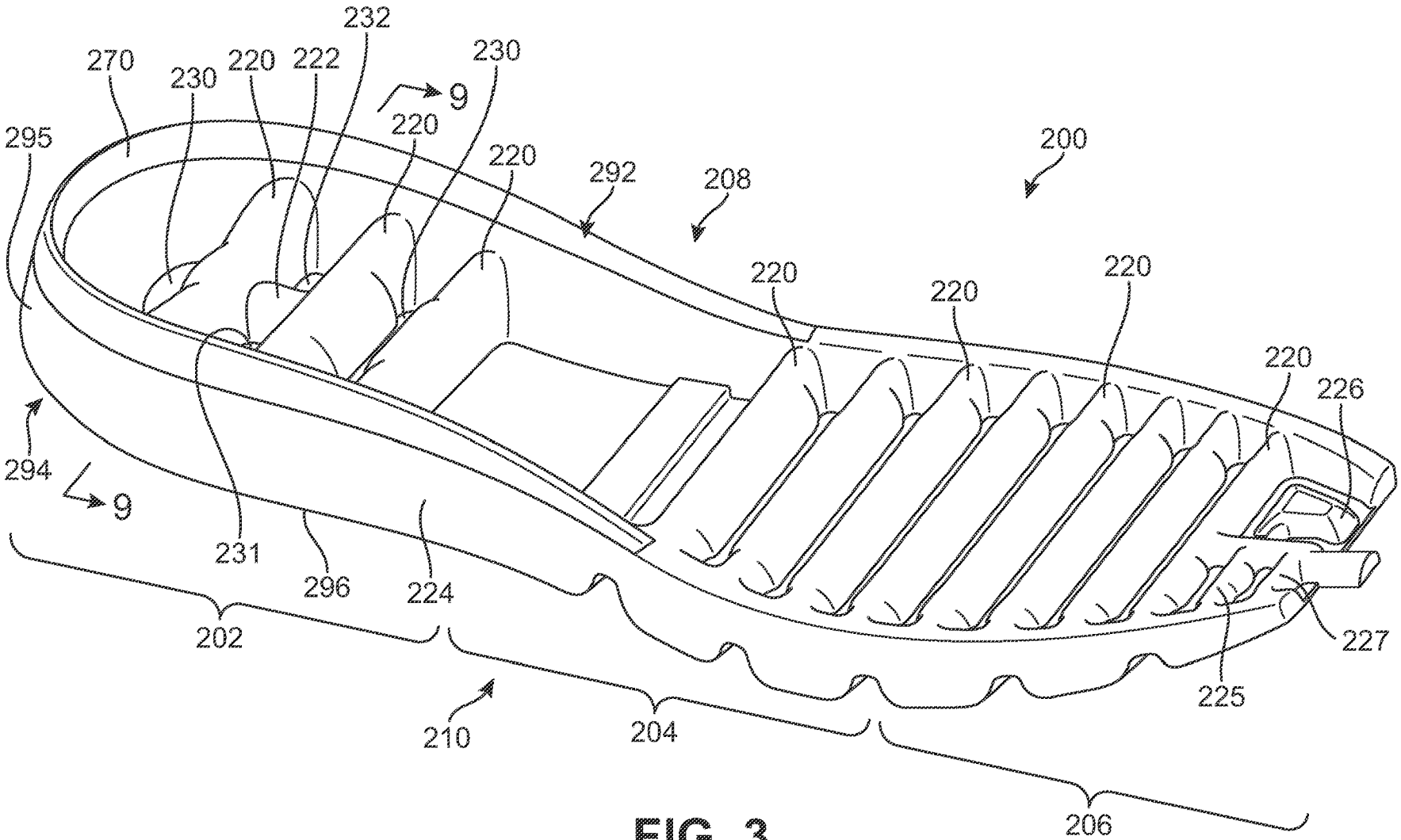
FIG. 3 is a perspective view of a fluid-filled chamber from the article of footwear.

FIG. 3 shows a perspective view of an exemplary configuration of chamber 200. When incorporated into footwear 100, chamber 200 may have a shape that fits within a perimeter of midsole 122 and substantially extends from forefoot region to heel region and also from lateral side 104 to medial side 106, thereby corresponding with a general outline of the foot. When a foot is located within upper 110, chamber 200 extends under substantially all of the foot in order to attenuate ground reaction forces that are generated when sole structure 120 is compressed between the foot and the ground during various ambulatory activities, such as running and walking. In other configurations, chamber 200 may extend under only a portion of the foot. As depicted in FIG. 1, chamber 200 forms a majority of an exposed side surface of sole structure 120. In other configurations, however, a polymer foam material of midsole 122 may extend entirely around chamber 200 and form the exposed side surface of midsole 122.

For purposes of reference in the following discussion, chamber 200 may be divided into three general regions: a forefoot region 206, a midfoot region 204, and a heel region 202. Forefoot region 206 generally includes portions of chamber 200 corresponding with the toes and the joints connecting the metatarsals with the phalanges. Midfoot region 204 generally includes portions of chamber 200 corresponding with an arch area of the foot. Heel region 202 generally corresponds with rear portions of the foot, including the calcaneus bone. Chamber 200 has a medial side 208 and an opposite lateral side 210, which may extend through each or regions 202, 204, and 206 and correspond with opposite sides of chamber 200. More particularly, lateral side 210 corresponds with an outside area of the foot (i.e. the surface that faces away from the other foot), and medial side 208 corresponds with an inside area of the foot (i.e., the surface that faces toward the other foot). Regions 202, 204, 206 and sides 208, 210 are not intended to demarcate precise areas of chamber 200. Rather, regions 202, 204, 206 and sides 208, 210 are intended to represent general areas of chamber 200 to aid in the following discussion.

Chamber 200 includes an upper barrier layer 292 and a lower barrier layer 294 that are substantially impermeable to a pressurized fluid contained by chamber 200. Whereas upper barrier layer 292 forms a first or upper surface of chamber 200, lower barrier layer 294 forms a second or lower surface of chamber 200. Additionally, upper barrier layer 292 extends downward to form a side surface or sidewall 295 of chamber 200. Sidewall 295 may, for example, form an exposed sidewall of sole structure 120. Moreover, upper barrier layer 292 and lower barrier layer 294 are bonded together around their respective peripheries to form a peripheral bond 296 adjacent to the lower surface of chamber 200. In configurations where lower barrier layer 294 forms sidewall 295, peripheral bond 296 may be located adjacent to the upper surface of chamber 200.

Peripheral bond 296 joins barrier layers 292 and 294 around the periphery of chamber 200 to form a sealed structure having an interior void or cavity, in which the pressurized fluid is located. The pressurized fluid contained by chamber 200 may induce an outward force upon barrier layers 292 and 294 that tends to separate or otherwise press outward upon barrier layers 292 and 294, thereby distending barrier layers 292 and 294. In order to restrict the degree of outwardly-directed swelling (i.e., distension) of barrier layers 292 and 294 due to the outward force of the pressurized fluid, a plurality of interior bonds 230 are formed between barrier layers 292 and 294, which will be discussed below.

A wide range of polymer materials may be utilized for chamber 200, specifically barrier layers 292 and 294. In selecting materials for chamber 200, engineering properties of the material (e.g., tensile strength, stretch properties, fatigue characteristics, dynamic modulus, and loss tangent) as well as the ability of the material to prevent the diffusion of the fluid contained by chamber 200 may be considered. When formed of thermoplastic urethane, for example, chamber 200 may have a thickness of approximately 1.0 millimeter, but the thickness may range from 0.2 to 4.0 millimeters or more, for example. In addition to thermoplastic urethane, examples of polymer materials that may be suitable for chamber 200 include polyurethane, polyester, polyester polyurethane, and polyether polyurethane. Chamber 200 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein layers include ethylene-vinyl alcohol copolymer, thermoplastic polyurethane, and a regrind material of the ethylene-vinyl alcohol copolymer and thermoplastic polyurethane. Another suitable material for chamber 200 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and U.S. Pat. No. 6,321,465 to Bonk, et al.

The fluid within chamber 200 may be pressurized between zero and three-hundred-fifty kilopascals (i.e., approximately fifty-one pounds per square inch) or more. In addition to air and nitrogen, the fluid may include octafluorapropane or be any of the gasses disclosed in U.S. Pat. No. 4,340,626 to Rudy, such as hexafluoroethane and sulfur hexafluoride. In some configurations, chamber 200 may incorporate a valve or other structure that permits the wearer to adjust the pressure of the fluid.

Chamber 200 includes various elements, including a plurality of elongated subchambers 220, a peripheral subchamber 224, and various interior bonds 230. Whereas peripheral subchamber 224 extends around a periphery of chamber 200 and forms the sidewall of sole structure 120, subchambers 220 extend across bladder 200 and join with opposite sides of peripheral subchamber 224. In other words, subchambers 220 extend between peripheral subchamber 224 and may be fluidically connected with peripheral subchamber 224. Moreover, interior bonds 230 extend between subchambers 220 and separate the fluid in adjacent subchambers 220 from each other. Chamber 200 may also include a sealed conduit 250, through which the fluid enclosed within chamber 200 has bee supplied, as will be discussed below.

Chamber 200 may contain one or more interior bonds 230. Interior bonds 230 may assist in forming an overall structure of the chamber 200. For example, in the absence of the interior bonds, the outward force induced by the pressurized fluid within chamber 200 would impart a rounded or otherwise bulging configuration to chamber 200, particularly in areas corresponding with the upper surface or upper barrier 292 and the lower surface or lower barrier 294. Such interior bonds 230 may be spaced inward sidewall 295, such as where peripheral bond 296 is located, and may be distributed throughout chamber 200. As a result, interior bonds may restrict the degree of outwardly-directed swelling or distension of barrier layers 292 and 294 and retain the intended contours of the upper surface and the lower surface provided by barrier layers 292 and 294.

Interior bonds 230 may exhibit a variety of configurations within the scope of the present invention. In heel region 202, the indentations formed by interior bonds 230 may have a greater depth than in forefoot region 206 due to the increased overall thickness of chamber 200 in heel region 202. In addition, the area of each interior bond 230 in heel region 202 is generally greater than the area of each interior bond 230 in forefoot region 206. The position of interior bonds 230 with respect to surfaces provided by upper barrier layer 292 and lower barrier layer 294 may also vary. For example, interior bonds 230 may be positioned so as to be closer to an upper surface provided by upper barrier layer 292, midway between upper and lower surfaces provided by barrier layers 292 and 294, or at a position that is closer to a lower surface provided by lower barrier layer 294.

Interior bonds 230 are formed between barrier layers 292 and 294 and separate one or more of subchambers 220 that enclose and contain the fluid of chamber 200. Subchambers 220 can provide areas filled with the pressurized fluid of chamber 200 that provide a shape that corresponds to a wearer's foot and cushion and support the foot. As shown in the example of FIG. 3, chamber 200 may include subchambers 220 in any of regions 202, 204, and 206. Subchambers 220 may cross chamber 200 and generally extend between opposite portions of peripheral subchamber 224, thereby generally extending between medial side 208 and lateral side 210 of chamber 200.

Subchambers 220 may also be provided in different numbers than shown in the example of FIG. 3. For example, heel region 202, midfoot region 204, and forefoot region 206 may have different numbers of subchambers than shown in FIG. 3. As shown in FIG. 3, subchambers 220 have an elongated shape with a longitudinal axis extending in a direction between medial side 208 and lateral side 210. In another configuration, the shapes and geometries may vary from subchamber to subchamber. For example, as shown in FIG. 3, a connecting portion 222 may connect subchambers 220 together, with connecting portion 222 sealed to enclose pressurized fluid, like subchambers 220. Connecting portion 222 may be provided between other subchambers of chamber 200 or no connecting portion 222 may be included in chamber 200.

In some embodiments, internal bonds 230 may extend laterally (i.e., in a direction extending between sides 208 and 210) and separate subchambers 220 from one another in a heel to forefoot direction of chamber 200. In some embodiments, internal bonds 230 may be parallel to one another. In some embodiments, where internal bonds 230 are parallel, internal bonds 230 may be elongate and extend continuously over a majority of a distance from the lateral side 210 to the opposite medial side 208. In different configurations of chamber 200, internal bonds 230 may vary in size, shape, or number. For example, internal bond 231 and internal bond 232 may separate portions of subchamber 220 from portions of an adjacent subchamber 220, such as when connecting portion 222 is provided, with internal bond 231 and internal bond 232 being located laterally of connecting portion 222 in a direction extending between medial side 208 and lateral side 210.

Although chamber 200 includes the various subchambers 220 discussed above, chamber 200 may also include a variety of other inflated structures. For example, chamber 200 may include inflated portion 226 in forefoot region 206 that has a generally polygonal shape or other desired shape to provide cushioning and support in forefoot region 206. To provide the shape of inflated portion 226, a bond 233 may be provided in chamber 200.

Figure 4:
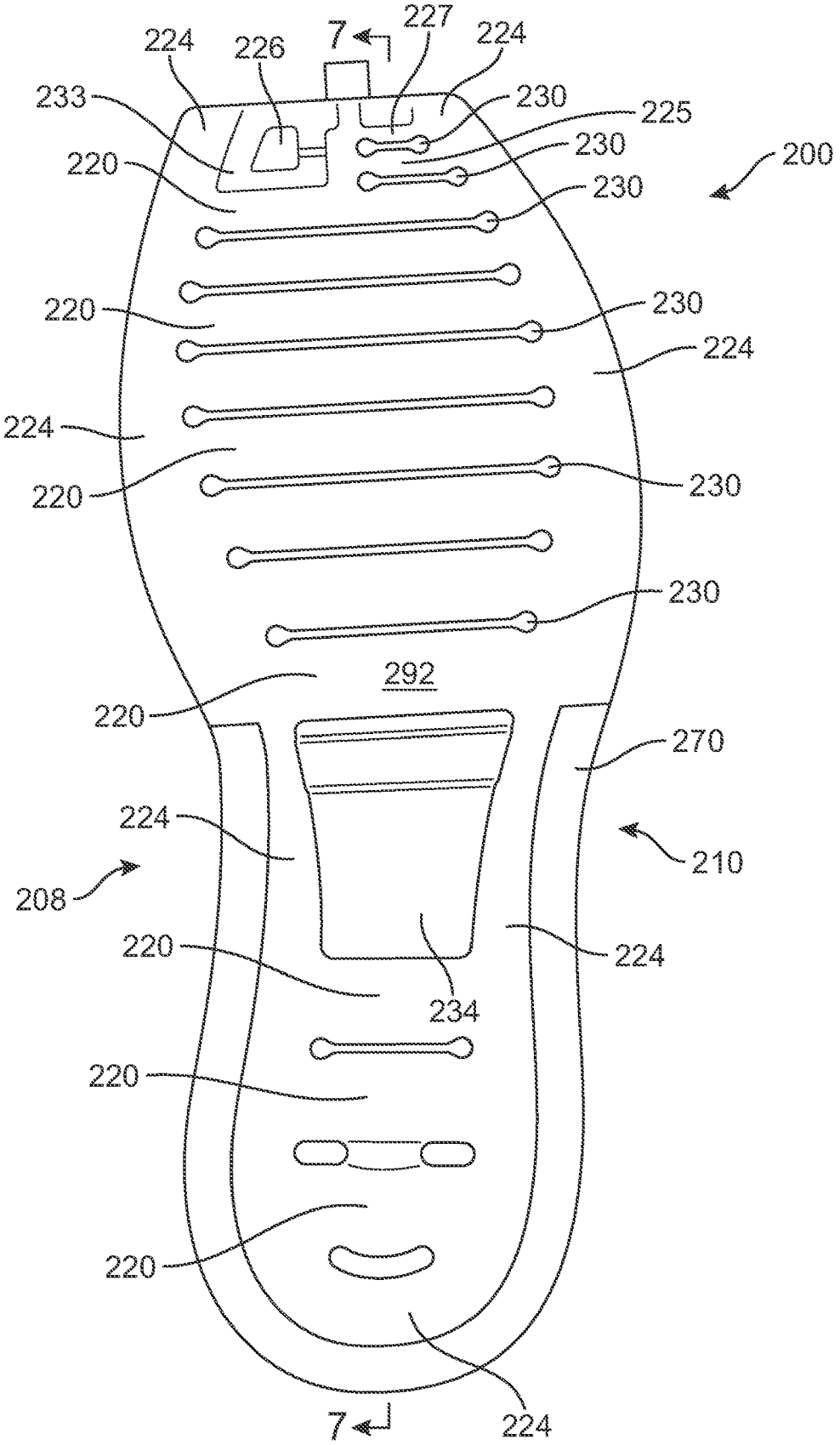
FIG. 4 is a top plan view of the fluid-filled chamber.

As shown in FIG. 4, peripheral subchamber 224 may substantially extend around the periphery of chamber 200 with an interruption at the toe in forefoot region 206. In another configuration, peripheral subchamber 224 may continuously extend around the periphery of chamber 200 without interruption. Peripheral subchamber 224 may extend around and be fluidically connected to subchambers 220 in heel region 202, midfoot region 204, and forefoot region 206. Such a structure may be implemented, for example, by providing internal bonds 230 that extend only a portion of a distance between medial side 208 and lateral side 210 so that internal bonds 230 do not extend completely from an edge at medial side 208 to an edge at lateral side 210. Similarly to the subchambers 220, peripheral subchamber 224 may provide a sealed area of pressurized fluid that cushions and supports a wearer's foot. In some configurations, peripheral subchamber 224 may extend upwards towards upper 110 of footwear 100 to a greater extent than subchambers 220 and/or may slope downwards towards a central portion of chamber 200 to provide a shape that may conform to a wearer's foot.

Figure 5:
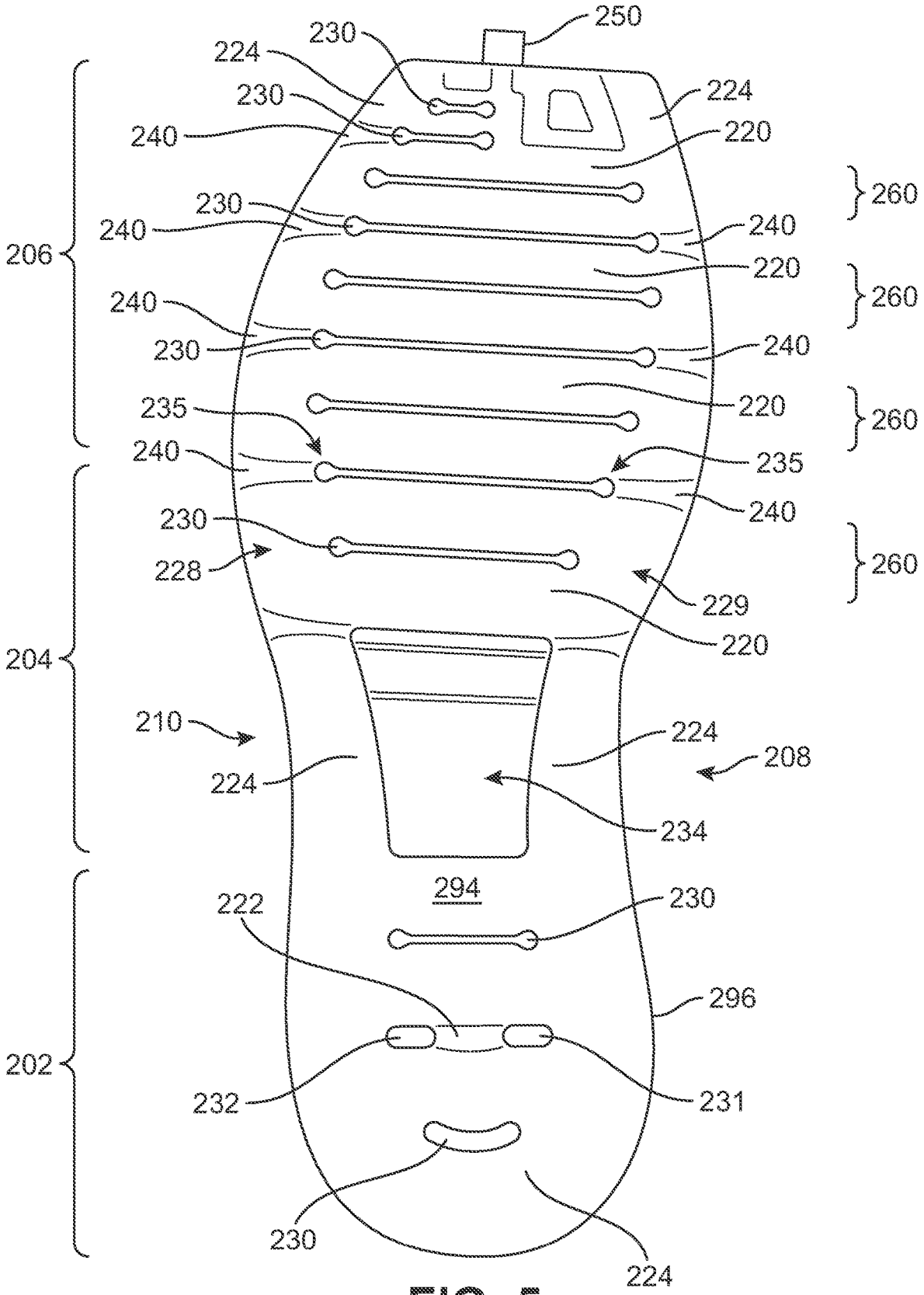
FIG. 5 is a bottom plan view of the fluid-filled chamber.

Although the configuration of chamber 200 may vary considerably, chamber 200 may include bonded areas or other features where no regions of pressurized fluid are present. As shown in FIGS. 4 and 5, chamber 200 may include bond area 234. Such bonded areas may be provided in any number as may be necessary to provide a desired shape and/or amount of cushioning for a wearer's foot and may be provided in different shapes and in different locations of chamber 200 than shown in the example of FIG. 5. In another example, chamber 200 need not include any bonded area 234.

As shown in the example of FIG. 5, which depicts a bottom view of chamber 200, internal bonds 230 might be arranged to extend across a portion of the width of chamber 200 in a direction between medial side 208 and lateral side 210 of chamber 200. For example, internal bonds 230 may extend laterally across only a portion of the width of chamber 200 in a direction between medial side 208 and lateral side 210 on the bottom surface of chamber 200. As a result, the subchambers 220 separated by these internal bonds 230 may be joined at their ends because the internal bonds extend across only a portion of the width of chamber 200. For example, ends of subchambers 220 on lateral side 210 of chamber 200 may be joined by joining portion 228 while ends of subchambers 220 on medial side 208 of chamber 200 may be joined by joining portion 229 on the bottom surface of chamber 200. Such joining portions 228, 229 may fluidically join subchambers 220. Joining portions 227, 229 may provide support to a wearer's foot but may also limit the flexibility provided by internal bonds to chamber 200 because joining portions 227, 229 may not bend as readily as internal bonds 230, for example, which may have a smaller thickness than joining portions 227, 229.

Flexibility of sole structure 120, including chamber 200, is a common design consideration due to the forces exerted upon footwear 100 while footwear 100 is worn. For example, during running or walking, sole structure 120 generally flexes or otherwise bends to accommodate the natural flexing of the foot, particularly in forefoot region 206 of chamber 200. The bonds provided in a bladder might not only serve to provide shape to inflated regions, such as subchambers, but may also provide flexibility to a bladder. For example, internal bonds 230 may provide areas with a degree of flexibility between subchambers 220. Such internal bonds 230 may provide a degree of flexibility by providing areas of a chamber 200 with a reduced thickness due to the joining of the upper and lower barrier layers 292 and 294 together.

Various indentations 240 may be provided on a bottom surface of chamber 200. Such an arrangement may provide increased flexibility to the bottom surface of a bladder. Indentations 240 may extend from end portion or area 235 of internal bonds 230 to sidewall 295 or other side edges of chamber 200 in a direction towards medial side 208 and towards lateral side 210, as shown in FIG. 5. For example, an indentation 240 may extend past an end area 235 of internal bond 230 nearest medial side 208 and extend to the edge of chamber 200 on medial side 208. Similarly, an indentation 240 may extend past an end area 235 of internal bond 230 nearest lateral side 210 and extend to the edge of chamber 200 on lateral side 210. Indentations 240 may be formed in chamber 200 as indentations in a bottom surface of peripheral subchamber 224 so that peripheral subchamber 224 has a reduced thickness where indentations 240 are located.

Such an internal bond structure may be provided to impart increased flexibility on the bottom surface of the chamber, such as by providing an area of decreased bladder thickness due to the joined surfaces of the upper barrier layer and the lower barrier layer and due to the indentations in the bottom surface of the chamber. Given that the degree of force necessary to bend an object is generally dependent upon the thickness of the object, the reduced thickness of chamber 200 in the areas of internal bonds facilitates flexing during movement of a wearer of footwear 100 that includes chamber 200 in its sole structure 120.

Indentations 240 may be configured so that subchambers 220 are separated into pairs on the lower surface. As shown in the example of FIG. 5, some internal bonds 230 may coincide with indentations 240. Internal bonds 230 coinciding with, indentations 240 may alternate with other internal bonds 230 circumscribed by subchamber pairs 260 without indentations 240. Such alternation of internal bonds 230 coinciding with indentations 240 and internal bonds 230 circumscribed by subchamber pairs 260 without indentations 240 may extend in a heel to toe direction on the lower surface of chamber 200, as shown in FIG. 5.

As shown in FIG. 5, subchamber pairs 260 may be separated from one another by internal bond 230 and indentations 240 that laterally extend towards medial side 208 and lateral side 210. In other words an internal bond 230 and an indentation 240 at each end of internal bond 230 may cooperate to form a recess extending entirely across the width of the bottom surface of chamber 200 of chamber 200 from lateral side 210 to medial side 208. Internal bonds 230 and indentations 240 also form a portion of a sidewall surface of chamber 200 located on lateral side 210 of the footwear and form a portion of a sidewall surface located on medial side 208 of the footwear, such as by forming indentations in the sidewall surfaces. Such an arrangement of subchamber pairs separated by internal bonds with laterally extending indentations advantageously provides a chamber structure with areas that support and cushion a wearer's foot, such as the subchamber pairs, while also providing increased flexibility and movement to the bladder, such as between the subchamber pairs where internal bonds with laterally extending indentations are located.

According to another example, internal bonds 230 between subchambers 220 may have a substantially continuous shape along a direction in which the internal bond extends. For instance, although FIG. 5 shows that internal bonds 230 and laterally extending indentations 240 may have different shapes, internal bonds 230 and indentations 240 may instead have a substantially continuous shape and/or size in a direction extending laterally between medial side 208 and lateral side 210. More particularly, the size and shape of subchambers 220, internal bonds 230, and indentations 240 may be the same or different.

Figure 6:
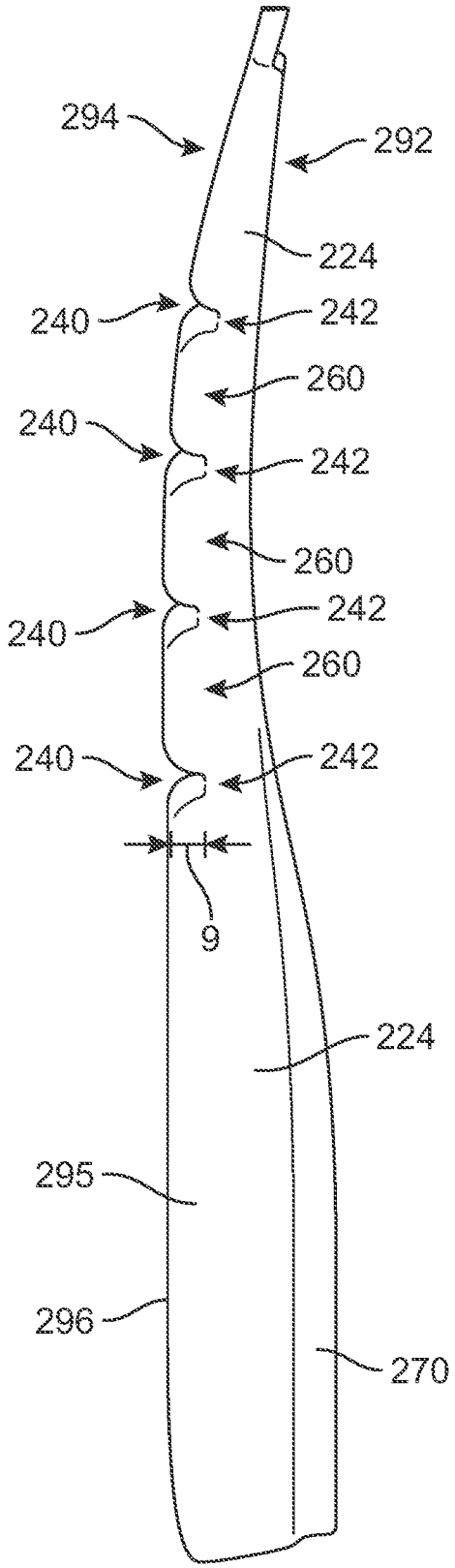
FIG. 6 is a side elevational view of the fluid-filled chamber.

In contrast with internal bonds 230, for example, indentations 240 on the bottom surface of chamber 200 do not join upper barrier layer 292 and lower barrier layer 294 of chamber 200. For example, as shown in FIG. 6, indentations 240 are located in the bottom surface of chamber 200 provided by lower barrier layer 294, which increase the flexibility of chamber 200 by providing areas where chamber 200 preferentially bends. Indentations 240 may have, for example, a depth 9 that is a portion of a thickness of chamber 200. The thickness of chamber may be measured along the same direction as depth 9, namely between a top surface of chamber 200 facing upper 110 and a bottom surface facing outsole 140. Depth 9 of indentations 240 may be, for example, 10-90% of the thickness of chamber 200. In another example, depth 9 of indentations 240 may be approximately 50% or more of the thickness of chamber 200. In a further example, depth 9 of indentations 240 may be approximately 50-90% of the thickness of chamber 200. Providing indentations 240 that have a depth 9 of approximately 50% or more of the thickness of chamber 200 may advantageously enhance the flexibility of chamber 200.

However, indentations 240 do not join upper barrier layer 292 to lower barrier layer 294 of chamber 200 where indentations 240 are located. As a result, there may be fluid-filled portions 242 located above indentations 240 in a direction extending between the lower barrier layer 294 to the upper barrier layer 292 so that there are fluid-filled portions 242 of chamber 200 between the indentations 240 and the upper barrier layer 292, as shown in FIG. 6. Thus, chamber 200 may simultaneously accommodating flexing and providing ground reaction force attenuation.

Fluid-filled portions 242 provided between indentations 240 and upper barrier layer 292 may be fluidically connected by peripheral chamber 224. Although indentations 240 may provide interruptions for peripheral chamber 224 on the bottom surface of chamber 200, as shown in FIG. 5, peripheral chamber 224 may extend over indentations 240 to connect fluid-filled portions 242 along a side surface and along a top surface of chamber 200, as shown in FIGS. 4 and 6.

Subchambers 220 of chamber 200 may vary in shape and/or size from one subchamber to another. The size or diameter of a subchamber 220 may be measured between a bottom surface and a top surface of chamber 200, which is also a direction 7 for measuring a thickness of subchamber 200. For example, a rearmost subchamber 220 in heel region 202 may have a size 5 along the thickness direction of chamber 200, while a chamber in the furthest tip of forefoot region 206 has a size 6.

Figure 7:
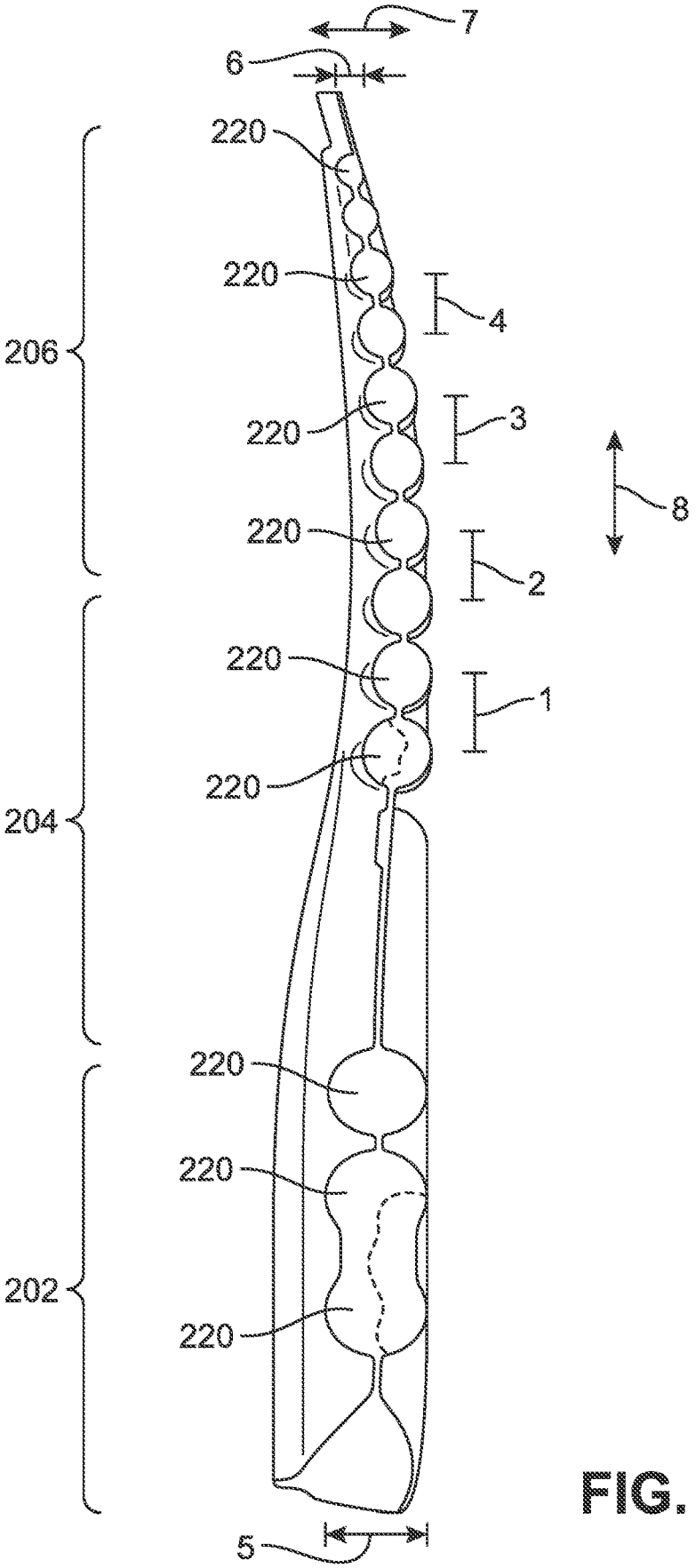
FIG. 7 is a cross-sectional view of the fluid-filled chamber, as defined by section line 7-7 in FIG. 5.

The size of subchambers 220 may vary from heel region 202 to forefoot region 206 along direction 8, with size 5 being larger than size 6. Such a variation of subchamber 220 size may provide chamber 200 with a thickness 7 that generally tapers from heel to forefoot and generally conforms to a shape of a foot. For example, subchambers 220 in heel region 202 may be larger than subchambers 220 in midfoot region 204 and forefoot region 206. In another example, subchambers 220 may decrease in size from one subchamber to the next adjacent subchamber. As shown in the example of FIG. 7, a distance may be measured from a center of one subchamber to a center of an adjacent subchamber, such as distance 1 from a center of a subchamber 220 to a center of subchamber 220, distance 2 from a center of subchamber 220 to another, distance 3 from a center of subchamber 220 to another, and distance 4 from subchamber 220 to another.

Subchambers 220 may decrease in size or diameter from midfoot region 204 to forefoot region 206. As a result, the distance between adjacent subchambers may decrease in a direction towards the toe, with distance 1 being greater than distance 2, distance 2 being greater than distance 3, and distance 3 being greater than distance 4.

Figure 8:
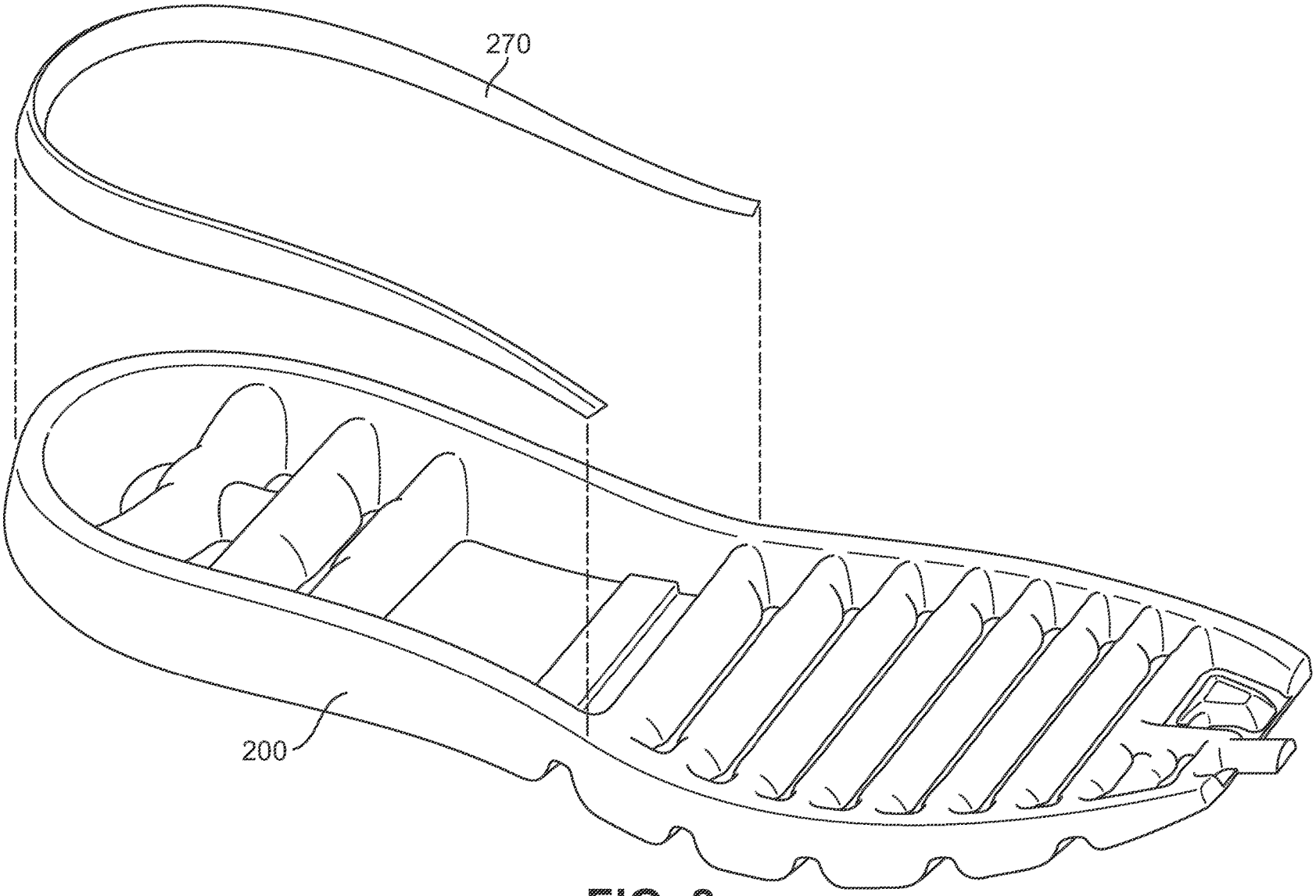
FIG. 8 is an exploded perspective view of the fluid-filled chamber.
Figure 9A:
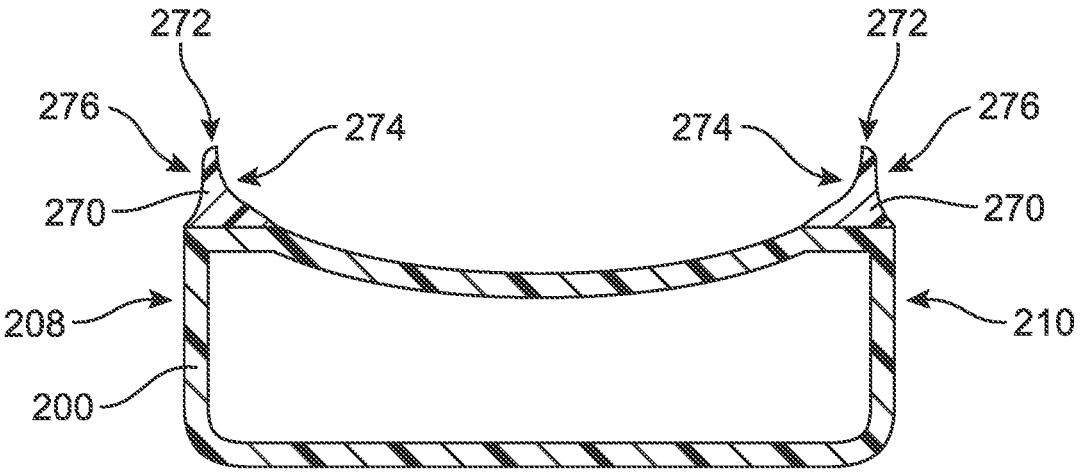
FIG. 9A is a cross-sectional view of the chamber after the chamber has been molded, as defined by section line 9-9 in FIG. 3.
Figure 9B:
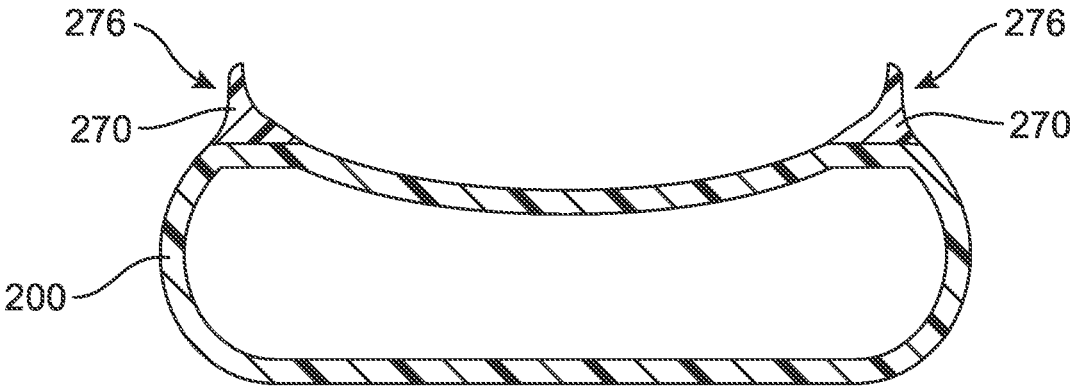
FIG. 9B is a cross-sectional view of the chamber of FIG. 9A after it has been inflated with fluid.

A chamber, such as chamber 200, may include one or more reinforcement members to provide additional strength to the chamber. A reinforcement member may be made of a different material than the remainder of the bladder, such as the upper and lower barrier layers of a chamber. U.S. Pat. No. 7,665,230 describes a reinforcement member and is hereby incorporated by reference in its entirety. As shown in the example of FIGS. 8, 9A, and 9B, chamber 200 includes a reinforcement member 270 as a separate piece that is bonded or otherwise secured to chamber 200. In general, reinforcement member 270 generally extends around portions and the periphery of chamber 200. The material forming reinforcement member 270 may exhibit a greater modulus of elasticity than the material forming chamber 200. Accordingly, the configuration and material properties of reinforcing reinforcement member 270 may impart reinforcement to sole structure 120 that includes chamber 200.

Upper portion 272 of reinforcing member 270 may extend along both the medial side 208 and lateral side 210 of chamber 200 and provide a defined lasting margin for securing upper 110 to sole structure 120 during the manufacture of footwear 100. One issue with some sole structures is that the precise extent to which the upper should be secured to the sole structure is not evident from the configuration of the sole structure. Referring to the cross-section of FIG. 9A, which shows a cross-sectional view of chamber 200 after chamber 200 has been molded but before inflation with fluid, reinforcing structure 270 forms a ridge 274 on both the medial and lateral sides for a sole structure. Ridge 274 is an identifiable line that defines a lasting surface, thereby defining the portions of sole structure 120 to which upper 110 should be secured. Accordingly, an adhesive, for example, may be placed between the portions of ridge 274 that are located on the medial and lateral sides in order to properly secure upper 110 to the lasting surface of sole structure 120.

Reinforcing structure 270 may further include a chamfered surface 276. Chamfered surface 276 may face outwardly towards medial side 208 and lateral side 210 to provide a smoothly transitioning surface between chamber 200 and reinforcing structure 270 once chamber has been inflated. Once molding is complete, chamber 200 may be inflated with fluid. As shown in the example of FIG. 9B, the sidewalls of chamber 200 may bulge outward towards medial side 208 and lateral side 210 when chamber 200 is inflated. However, the curvature of chamfered surface 276 of reinforcing structure 270 may provide a relatively smooth transition between the sides of chamber 200 and reinforcing structure 270, as shown in FIG. 9B.

Manufacturing Process

Figure 10A:
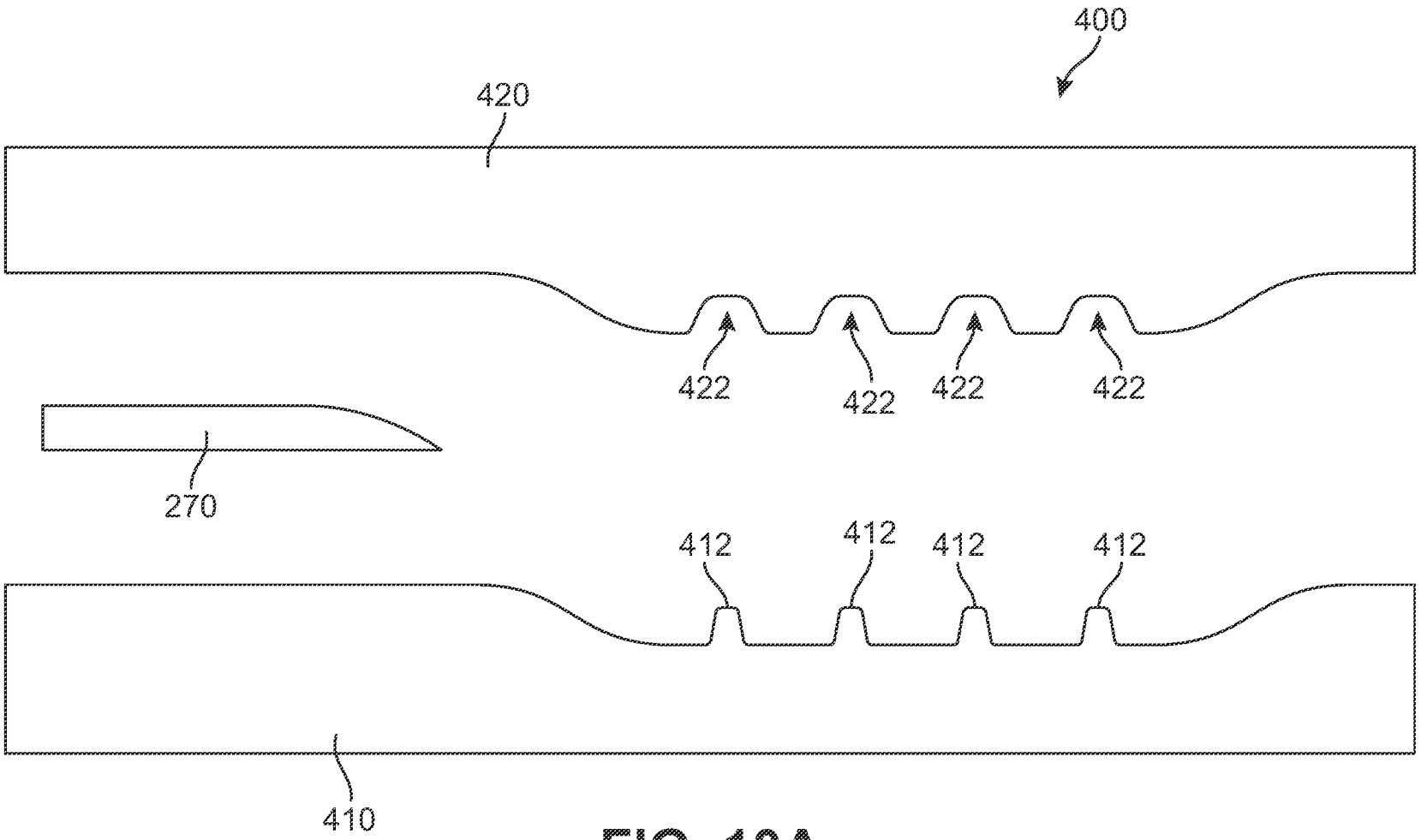
FIG. 10A is a side view of a molding apparatus used in a process for manufacturing a fluid-filled chamber.
Figure 10B:
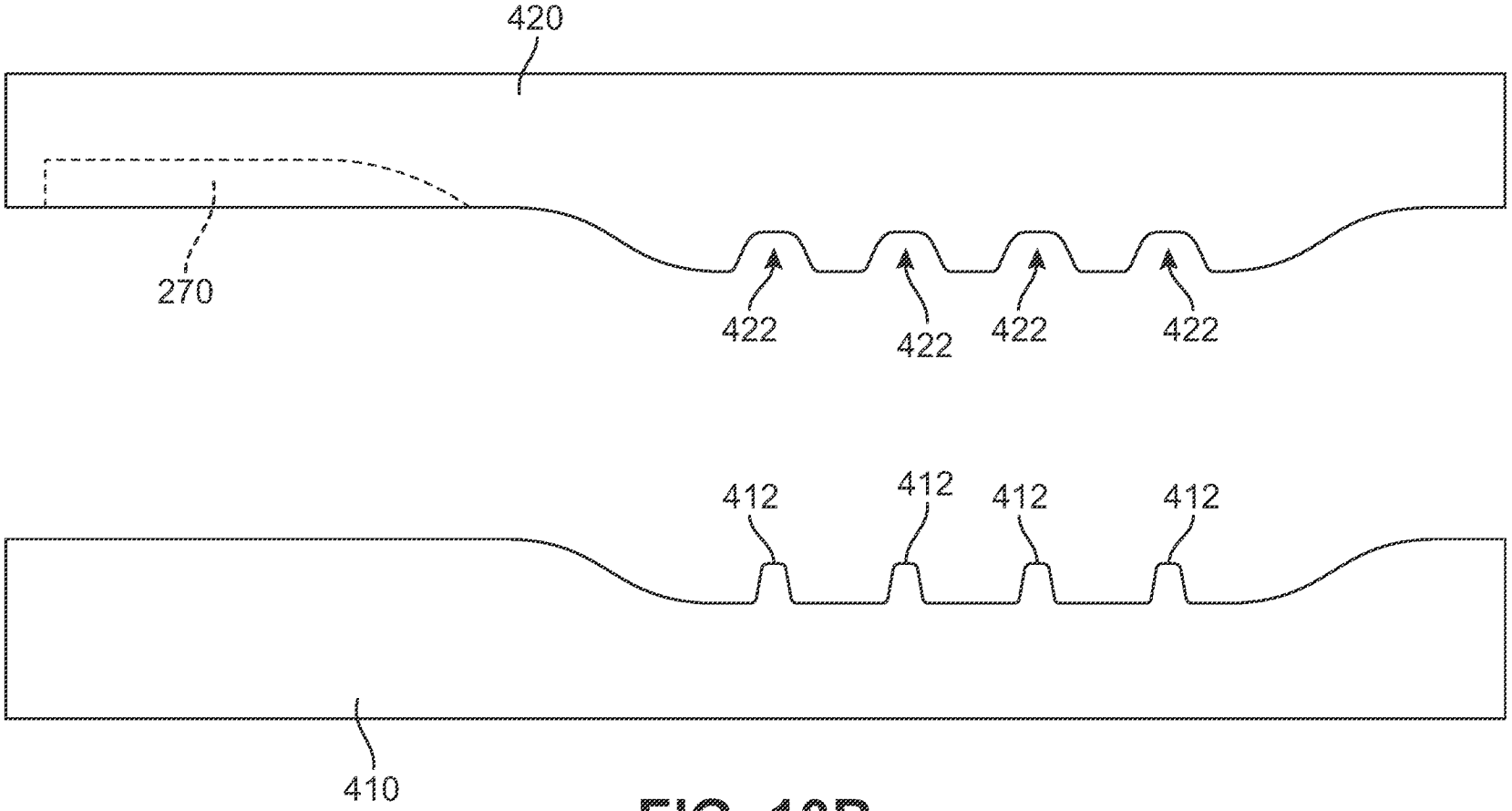
FIG. 10B is a side view of a molding apparatus used in a process for manufacturing a fluid-filled chamber including an insert.
Figure 10C:
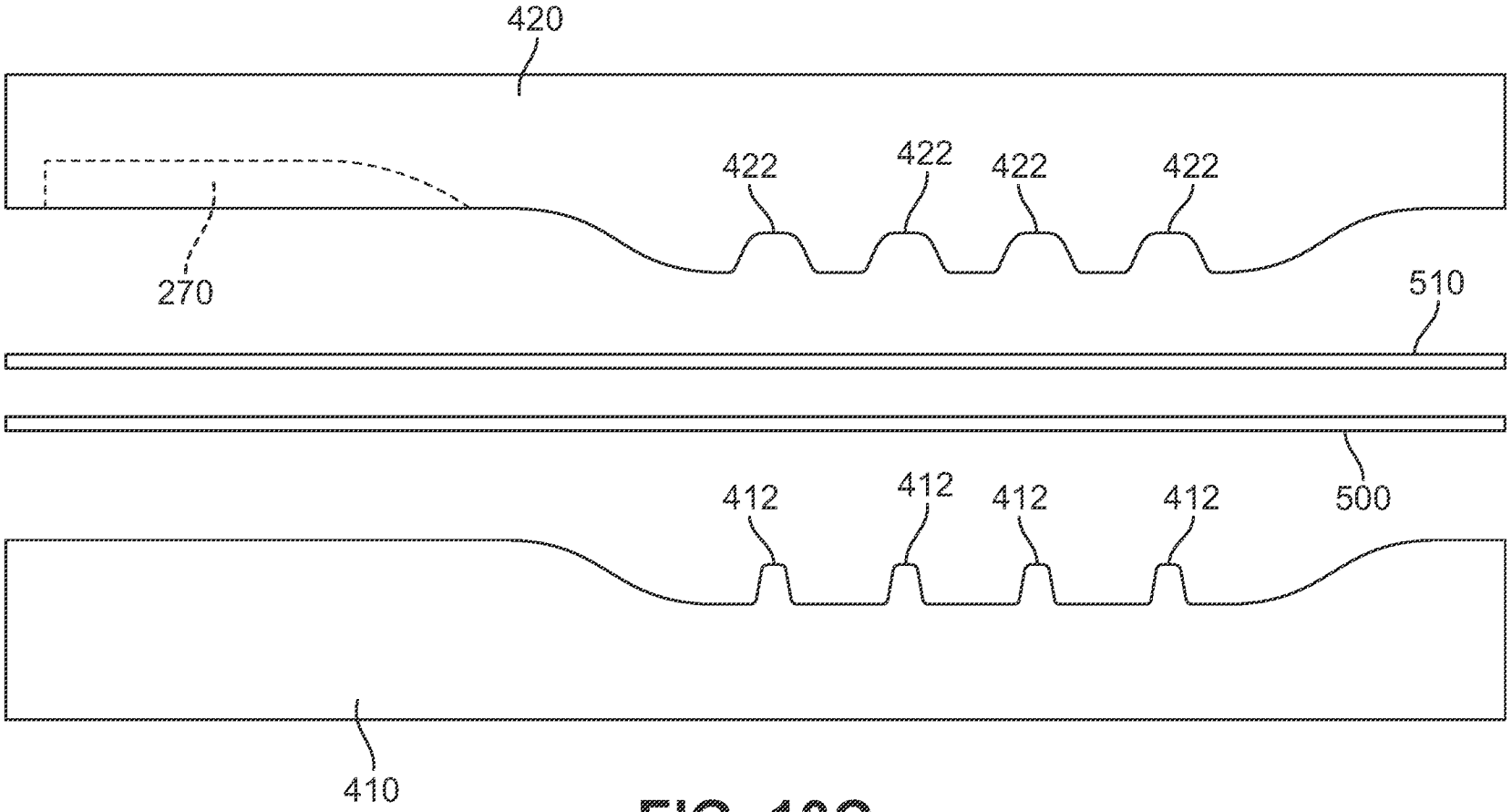
FIG. 10C is a side view of a molding apparatus used in a process for manufacturing a fluid-filled chamber including barrier layers.

Turning to FIGS. 10A-10D, an exemplary process is shown for producing chamber 200. As shown in FIG. 10A, a mold 400 may be provided, which includes an upper half 420 and a lower half 410. Upper half 420 and lower half 410 combine to form an internal cavity having a general shape corresponding with chamber 200. As an initial step in the process of forming chamber 200, reinforcement member 270 may be located within mold 400 so that reinforcement member 270 is molded, bonded, or otherwise secured to chamber 200 during later stages of the molding process. As shown in the example of FIG. 10B, reinforcement member 270 may be placed within one of the mold halves, such as upper half 420 and in a portion of the cavity corresponding with the location of 270 in chamber 200. Subsequently, a first sheet 500 and a second sheet 510 may be placed within mold 400, as shown in FIG. 10C. First sheet 500 and second sheet 510 may be provided as lower and upper barrier layers for a bladder and may be made from the materials described above for barrier layers. More particularly, sheets 500 and 510 respectively form barrier layers 292 and 294 in chamber 200

Figure 10D:
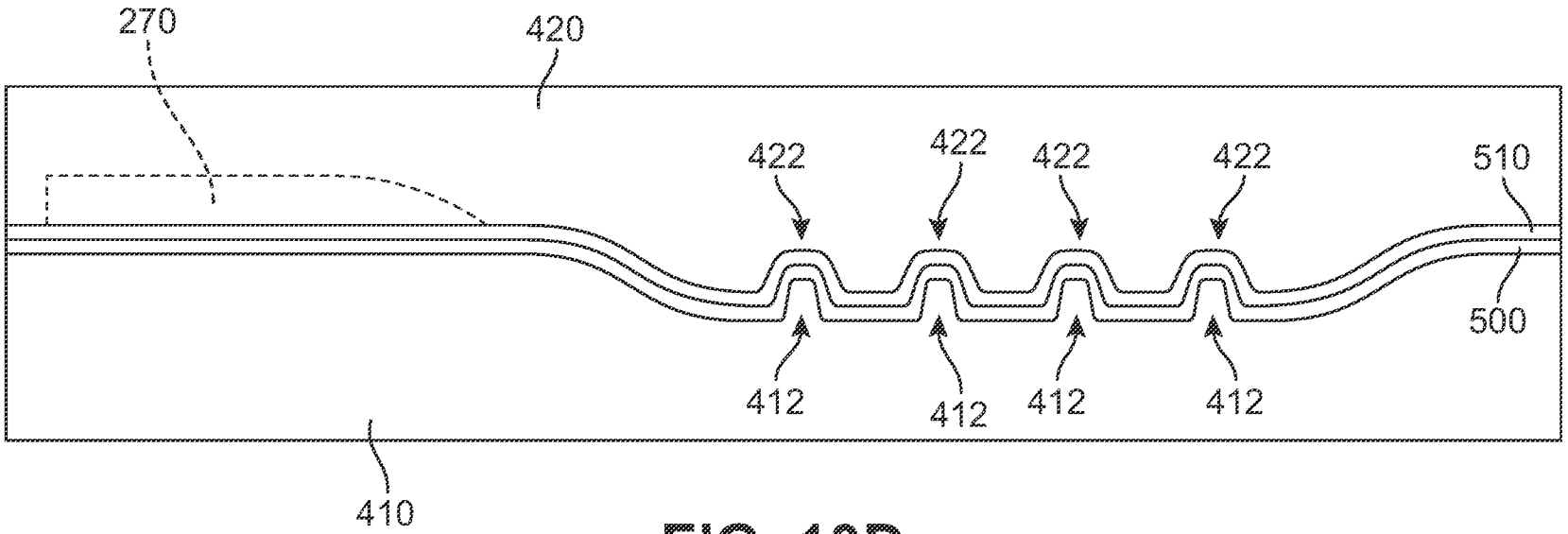
FIG. 10D is a side view of a molding apparatus used in a process for manufacturing a fluid-filled chamber after the apparatus has been closed.

Lower half 410 may include projections 412 while upper half 420 includes indentations 422 corresponding with projections 412. Projections 412 and indentations 422 correspond with indentations 240 of chamber 200. As a result, when upper mold 420 and lower mold 410 are closed together, as shown in FIG. 10D, first sheet 500 and second sheet 510 are heated and conform to the shape of the surfaces of upper mold 420 and lower mold 410, with first sheet 500 and second sheet 510 being bonded in the areas of indentations 422 and projections 412 to form structures in chamber 200, such as internal bonds 230 and indentations 240 of chamber 200. Other projections and indentations may be included to provide other bonded areas of bladder, such as the internal bonds described above.

Figure 10E:
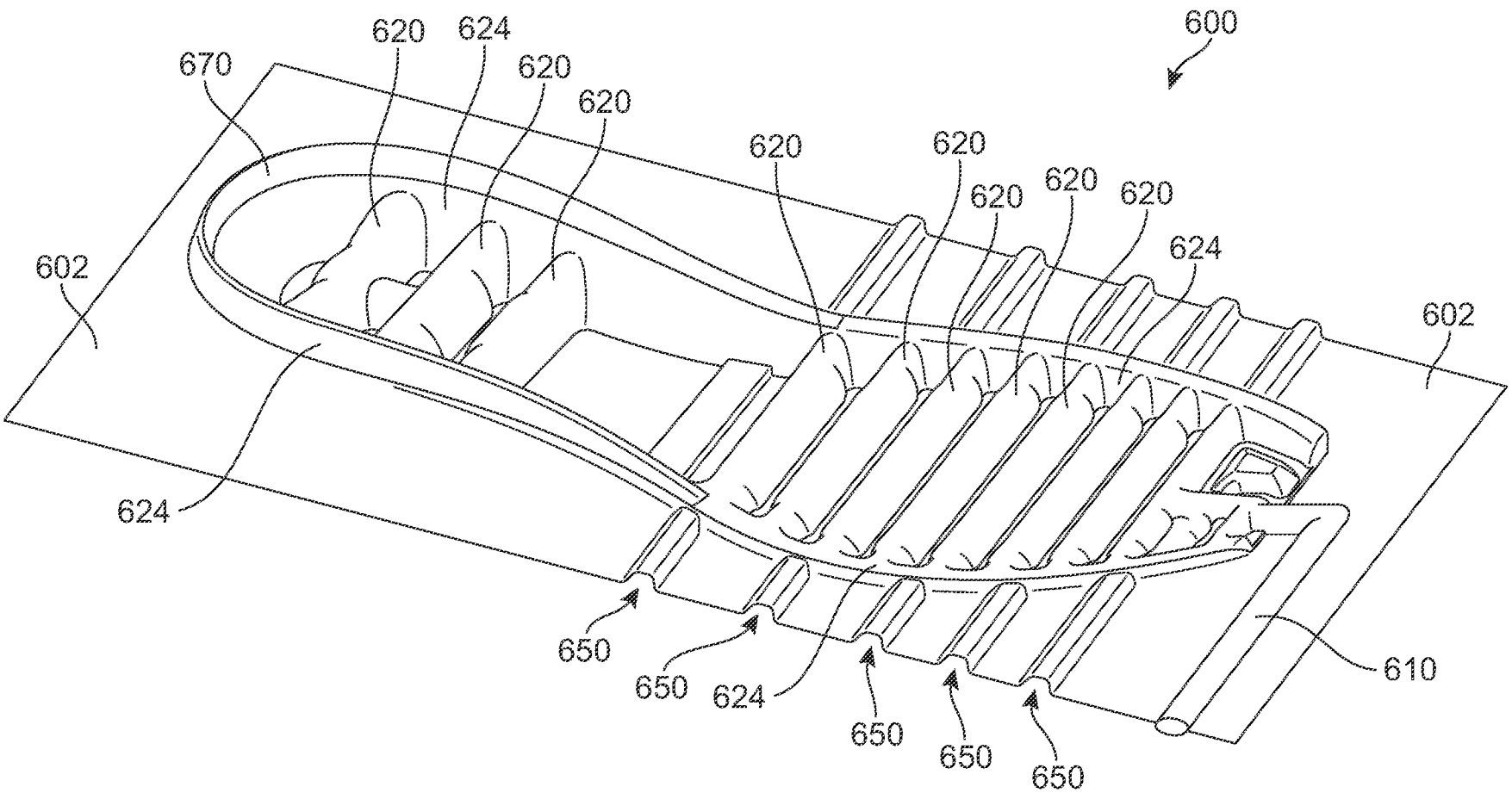
FIG. 10E is a perspective view of a product of a molding apparatus.

FIG. 10E shows an exemplary molded product 600 produced by a process similar to that described above. Molded product 600 may include an outer bonded portion 602 which has been produced by first sheet 500 and second sheet 510 being pressed and bonded between mold halves. A central portion of molded product 600 may include the structure of chamber 200. For example, the molded product 600 may include a peripheral subchamber 624 and subchambers 620 in heel, midfoot, and forefoot regions. A conduit 610 is provided in the molded product 600 so that pressurized fluid may be introduced during the molding process to inflate the molded product 600, with the conduit 610 being subsequently closed to provide sealed conduit 250 and seal the fluid within unbonded areas of the molded product 600. Molded product 600 may include indentations 650 extending through bonded portion 602 and into the central area of molded product 600 to form indentations 240 discussed above. Indentations 650 may correspond to and be formed by the indentations 422 and projections 412 of mold halves 410, 420 discussed above, so that when mold halves 410, 420 close together, indentations 240 are formed between indentations 422 and projections 412.

Further Configurations

Figure 11:
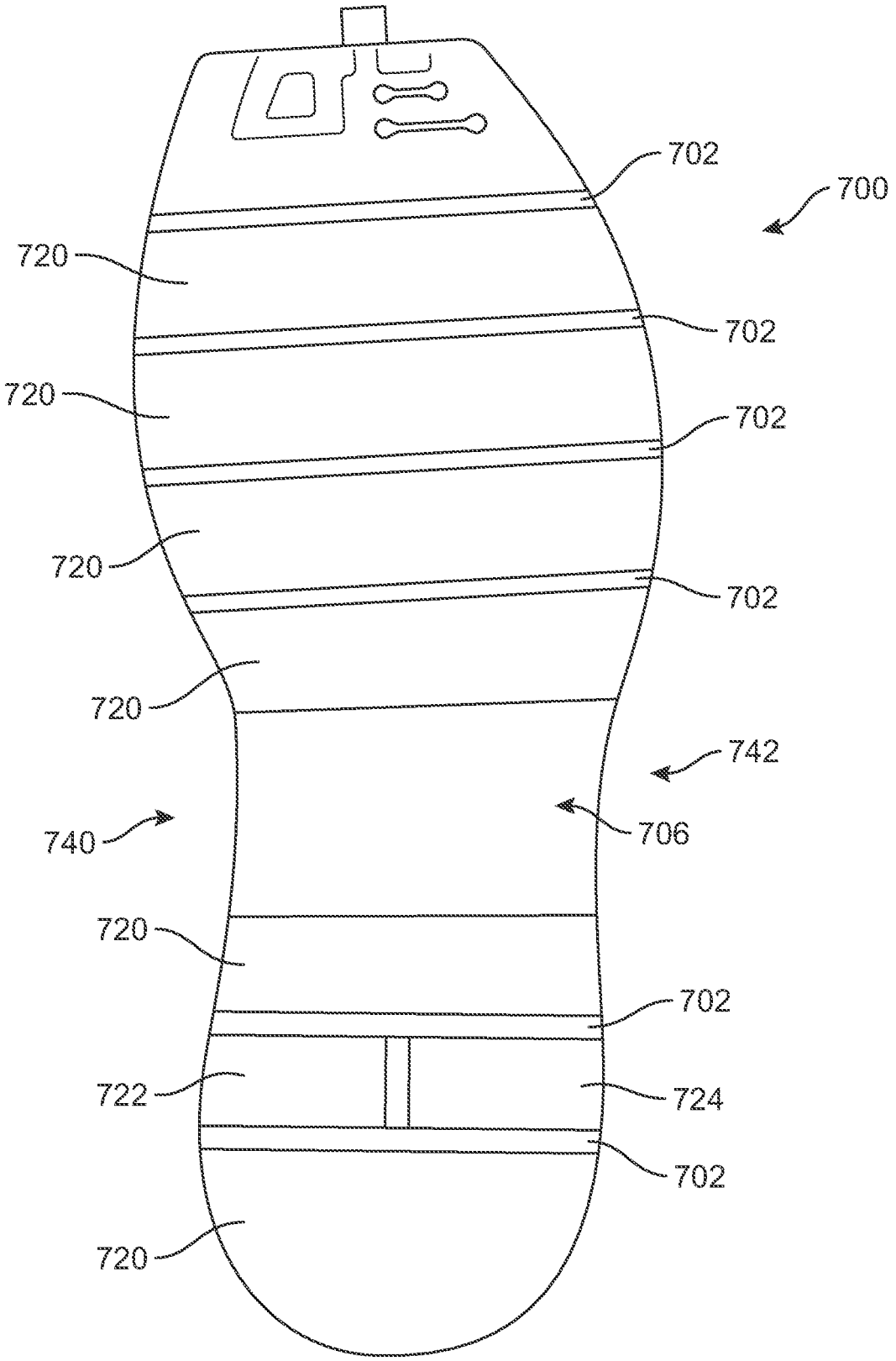
FIG. 11 is a top view of a further configuration of a fluid-filled chamber.

As shown in the example of FIG. 11, a chamber 700 may be provided that does not include a peripheral subchamber. Chamber 700 may include inflated areas 720 and bonded areas 702. Bonded areas 702 may separate inflated areas 720 from one another and may continuously extend across chamber 700 from a medial side 740 to a lateral side 742, as shown in FIG. 11. Further, bonded areas 702 may have a substantially continuous shape in a direction extending between medial side 740 and lateral side 742, as shown in FIG. 11, or may have varying shapes as shown in FIG. 4. Inflated areas 720 may be provided in the form of tubes or other shapes and may vary in number and size, as discussed herein.

Figure 12:
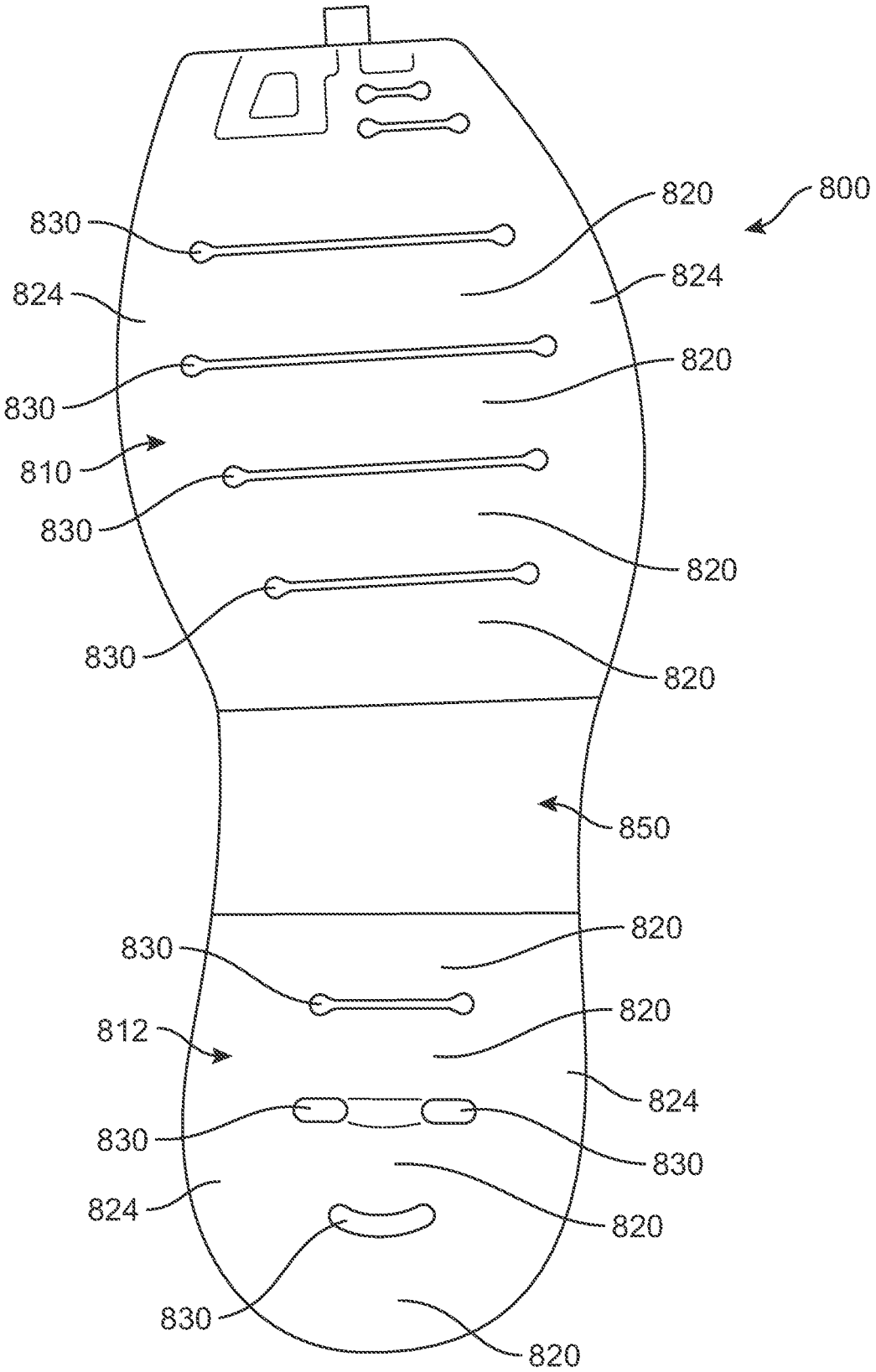
FIG. 12 is a top view of a further configuration of a fluid-filled chamber.

A chamber may include separate inflated portions. As shown in FIG. 12, a chamber 800 may include a first inflated region 810 and a second inflated region 812 separated by a bonded area 850. Bonded area 850 may completely seal upper and lower barrier layers of bladder 800 so that first inflated region 810 and second inflated region 812 are not fluidically connected, or first inflated region 810 and second inflated region 812 may be fluidically connected. First inflated region 810 and second inflated region 812 may each include a peripheral chamber 824 and subchambers 820 and internal bonds 830.

Figure 13:
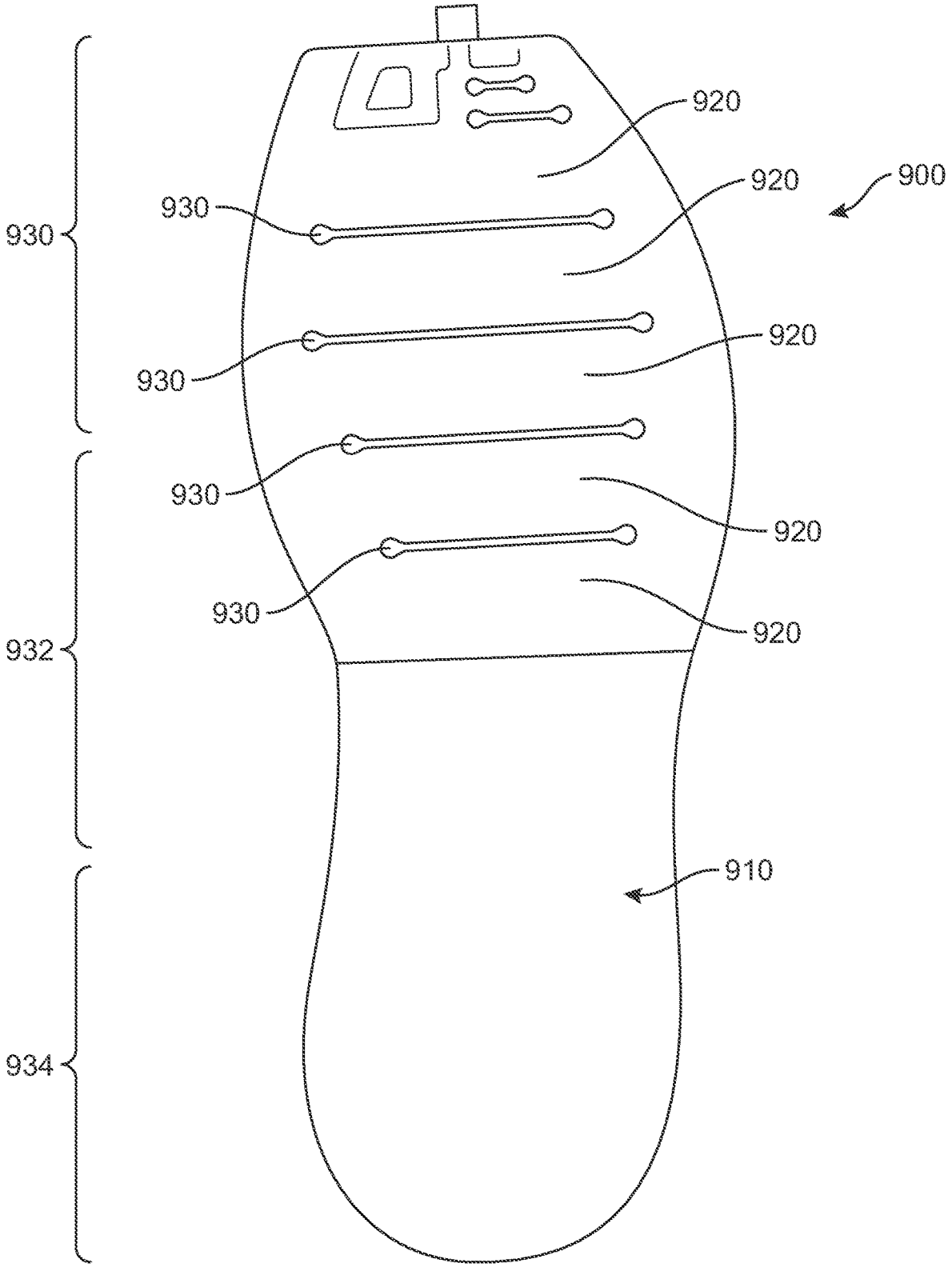
FIG. 13 is a top view of a further configuration of a fluid-filled chamber.
Figure 14:
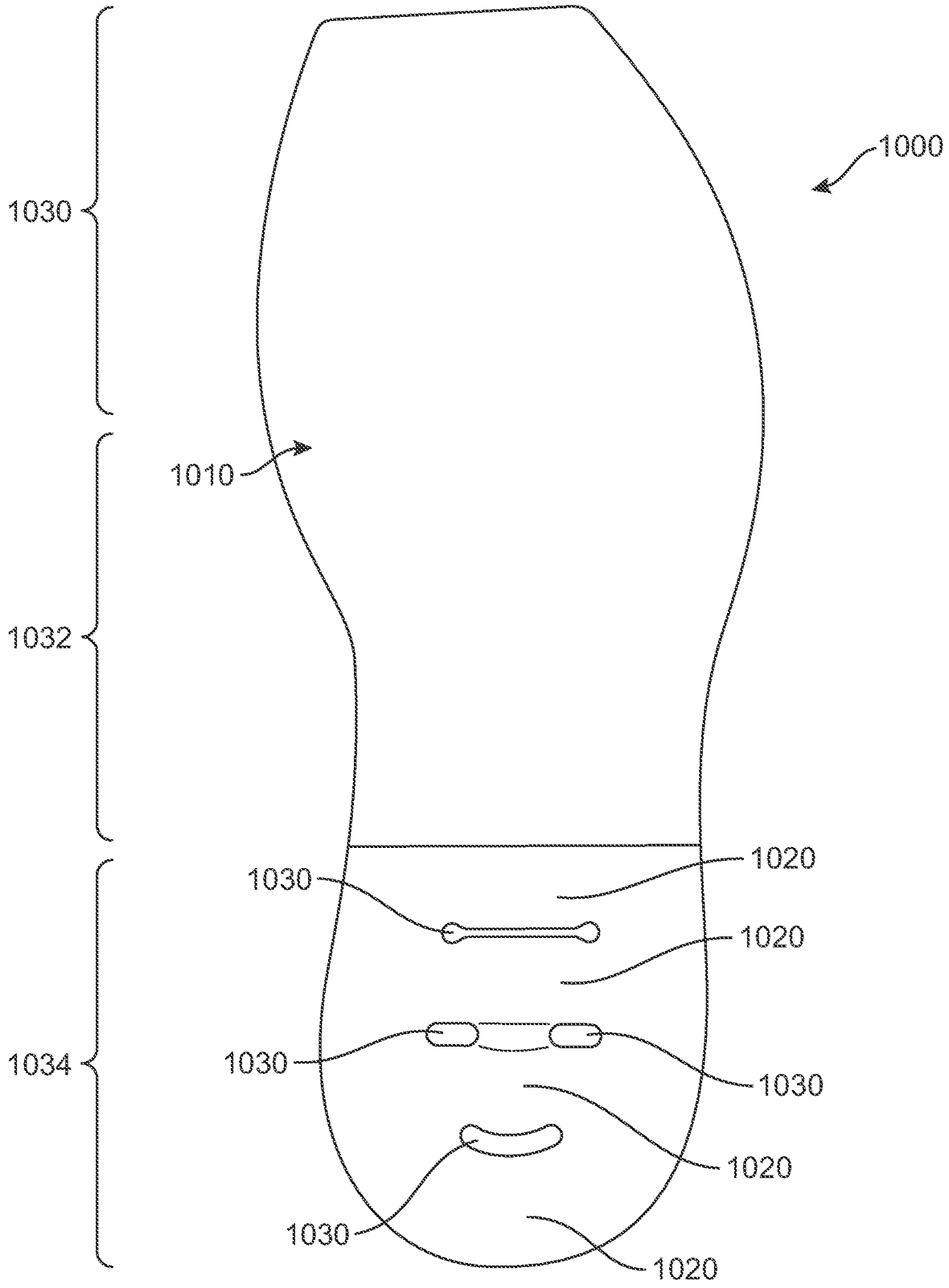
FIG. 14 is a top view of a further configuration of a fluid-filled chamber.

In some configurations, only a portion of a chamber may include inflated portions. As shown in FIG. 13, a first region of a chamber 900 may include subchambers 920 enclosing a pressurized fluid and having internal bonds 930 while a second region is provided by a bonded area 910. The first region of chamber 900 may be provided in a midfoot region 932 and/or forefoot region 930, while bonded area 920 may be provided in a heel region 934 and may also extend into midfoot region 932. In another configuration, a chamber 1000 may include a bonded region 1010 in a forefoot region 1030, which may also extend into a midfoot region 1032, as shown in FIG. 14, while a heel region 1034 includes an inflated portion with internal bonds 1030 and subchambers 1020. According to another example, inflated portion in heel region 1034 may also extend into midfoot region 1032 in FIG. 14.

Figure 15:
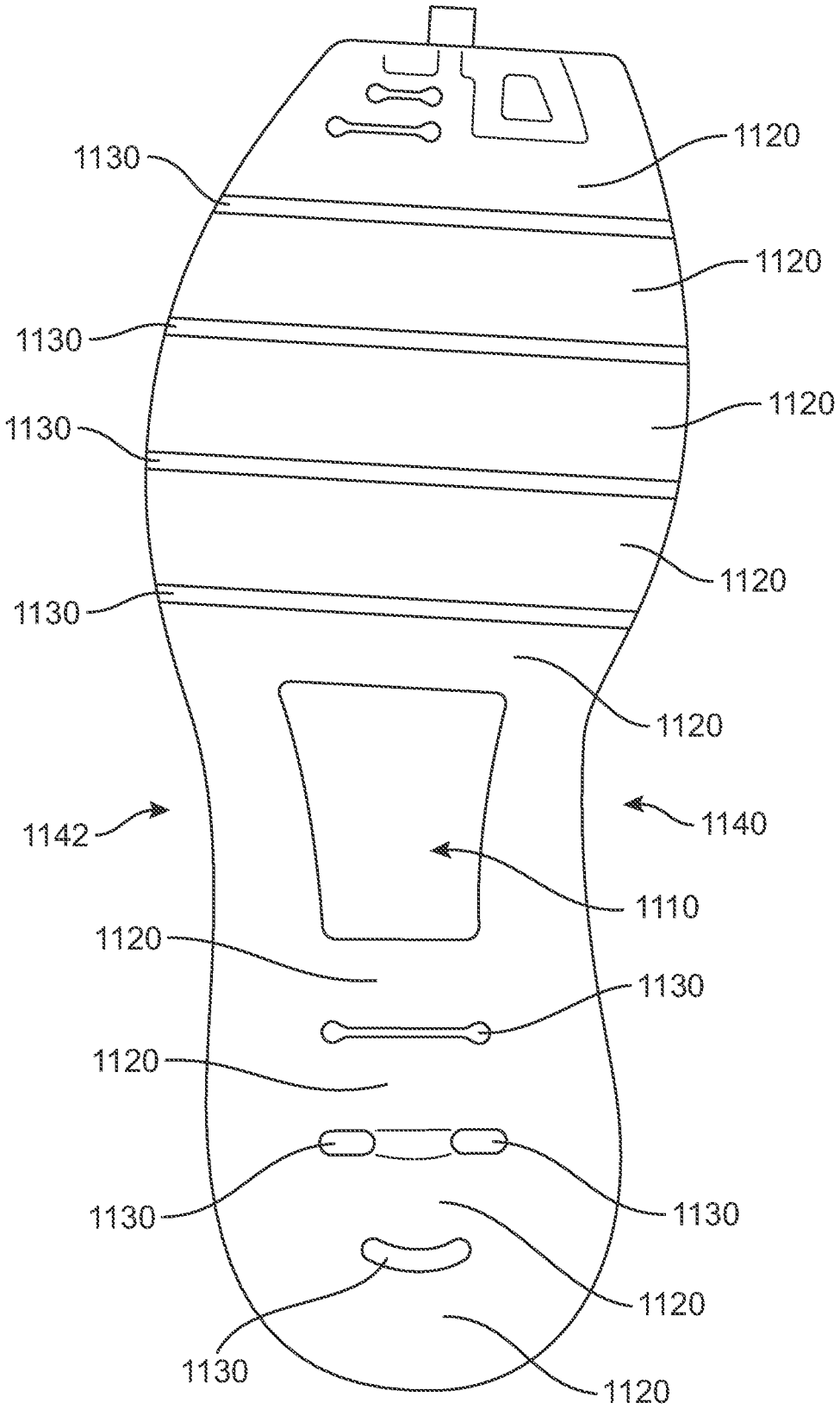
FIG. 15 is a bottom view of another fluid-filled chamber.

Instead of providing subchambers in pairs on a bottom surface of a chamber, as shown in FIG. 5, subchambers may be individually separated on the bottom surface by bonds running laterally from one edge to another. Turning to FIG. 15, which depicts a bottom view of a chamber, subchambers 1120 and internal bonds 1130 and a bonded area 1110 may be similar to those discussed above. However, subchambers 1120 may be separated from one another by bonds 1130 that laterally extend between an edge on medial side 1140 and an edge on lateral side 1142. As shown in the example of FIG. 15, bonds 1130 may have a substantially uniform or continuous shape from medial side 1140 to lateral side 1142, or bonds 1130 may have a shape with laterally extending portions as shown in FIG. 5. Although subchambers 1120 in the heel region are not individually separated by bonds in FIG. 15, subchambers 1120 in the heel region may also be individually separated by bonds 1130.

Figure 16:
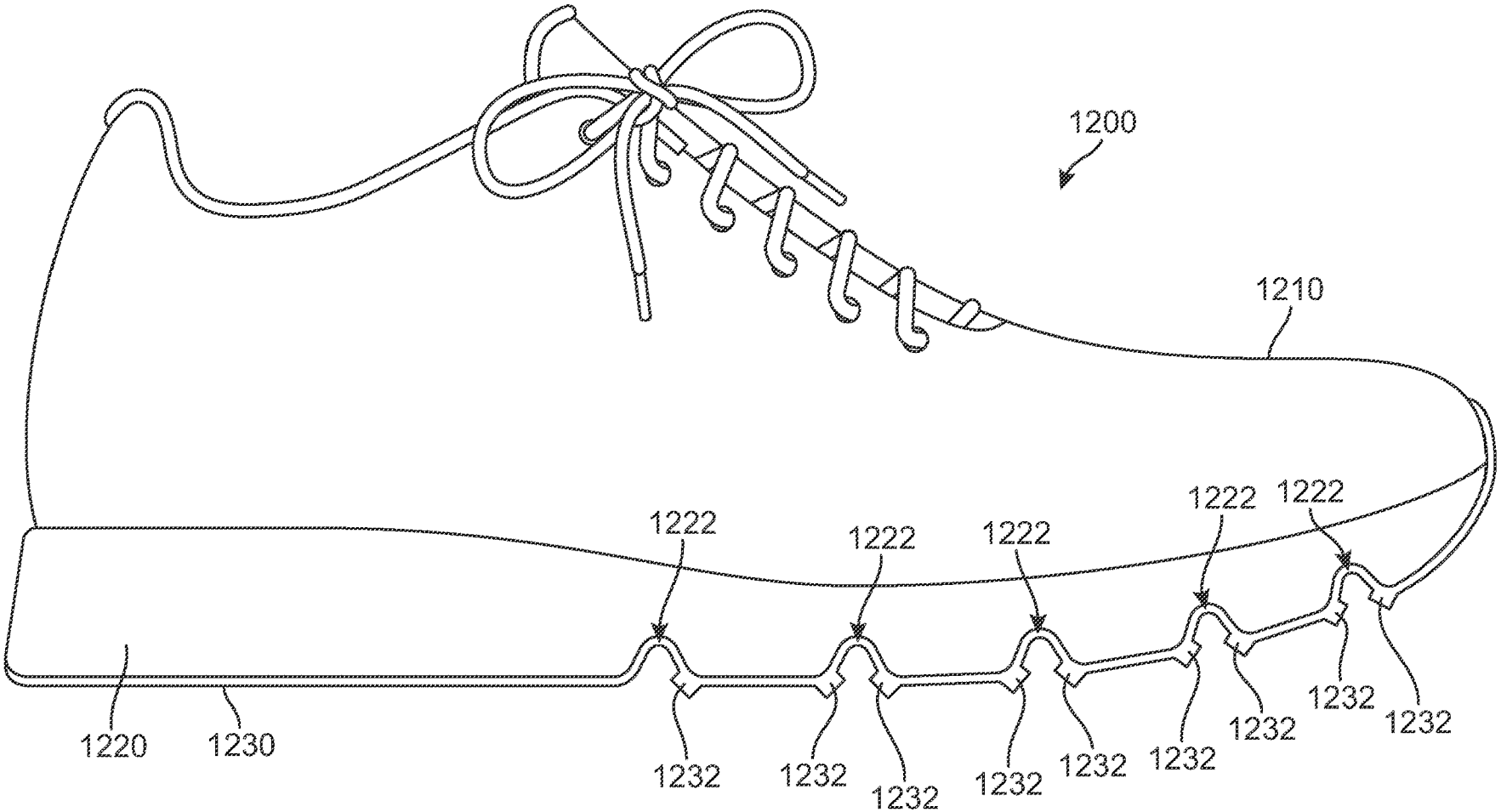
FIG. 16 is a side view of another article of footwear.

FIG. 16 shows a side view of an article of footwear 1200, which includes an upper 1210 and a midsole 1220 that includes the features according to any of the configurations described herein. Midsole 1220 may include flexion indentations 1222, which may correspond to indentations 240 of chamber 200. Footwear 1200 may also include an outsole 1230 that extends into flexion indentations 1222, as shown in FIG. 16, thereby forming a stiffer, less compressible areas that also facilitate flexing about flexion indentations 1222. Outsole 1230 may also include ground engaging members, such as lugs 1232. As shown in the example of FIG. 16, lugs 1232 may be located relative to flexion indentations 1222 so that lugs 1232 are not located within flexion indentations 1222. As a result, the location of lugs 1232 may have minimal effect upon the bending of midsole 1220 and outsole 1230 at flexion indentations 1222.

Other alternative arrangements and configurations for a chamber may be provided. For example, although FIG. 3 shows chamber 200 having subchambers 220 in heel region 202, midfoot region 204, and forefoot region 206, subchambers 220 and corresponding internal bonds 230 may be located in only one of these regions, two or these regions, or one of these regions. For example, subchambers 220 may be located in only one of the heel region 202, midfoot region 204, and forefoot region 206 while the remainder of chamber 200 includes a large bonded area or a large area including pressurized gas. In another example, two of heel region 202, midfoot region 204, and forefoot region 206 may include subchambers 220 while the remainder of chamber 200 includes a large bonded area or a large area including pressurized gas.

As discussed above, subchambers 220 may vary in number and may vary in shape and/or size. In addition, internal bonds 230 may also vary in number, shape, and/or size. For example, chamber 200 may include subchamber 225 and subchamber 227 in forefoot region 206 of chamber 200 that do not extend between medial side 208 and lateral side 210 of chamber. Internal bonds 230 separate subchamber 225 from subchamber 227. As shown in the example of FIG. 4, subchambers 225, 227 may be smaller than other subchambers 220 in midfoot region 204 and forefoot region 206, with subchambers 225, 227 extending to a smaller extent in a direction between medial side 208 and lateral side 210 than subchambers 220.

Although the example of FIG. 5 depicts chamber 200 as including four subchamber pairs 260, any number of subchamber pairs 260 may be utilized in chamber 200, such as when (a) multiple chambers 200 are provided in different sizes according to the size of a wearer's foot and (b) different degrees of support or force attenuation are desired. Subchamber pairs may also vary in shape and/or size and may extend in different directions than just laterally across the width of a chamber between a medial side and lateral side. Although internal bonds and indentations 240 may extend laterally as shown in FIG. 5, (i.e., between medial side 208 and lateral side 210) across the lower surface of chamber 200, which may be suitable for footwear structured for running and a variety of other athletic activities, internal bonds and indentations 240 may extend in a generally longitudinal direction (i.e., between forefoot region 206 and heel region 202) in footwear structured for athletic activities such as basketball, tennis, or cross-training. Accordingly, internal bonds and indentations 240 may extend in a variety of directions in order to provide a defined line of flexion in sole structure 120.

The figures depict internal bonds 230 and indentations 240 as extending entirely across chamber 200. In some configurations, however, internal bonds 230 and indentations 240 may extend only partially across a portion of chamber 200. In addition, internal bonds 230 and indentations 240 may be provided in different locations than those shown in the example of FIG. 5. The location of indentations 240 may be selected, for example, based upon an average location of the joints between the metatarsals and the proximal phalanges of a foot. However, depending upon the specific configuration and intended use of a sole structure 120 including chamber 200, however, the location of indentations 240 may vary.

According to another example, indentations 240 join upper barrier layer 292 to lower barrier layer 294 of chamber 200, in contrast to FIG. 6, in which indentations 240 do not join upper barrier layer 292 to lower barrier layer 294.

Subchambers may have any generally elongate structure that has a hollow interior for enclosing a portion of the fluid within chamber 200. Although subchambers may have a circular cross-sectional shape that provides a cylindrical structure, as shown in FIG. 7, subchambers may also have oval, triangular, square, hexagonal, non-regular, or a variety of other cross-sectional shapes.

As noted above, subchambers may decrease in size and diameter in a direction extending between a heel and toe of a bladder. However, the distance between the centers of subchambers may also be affected by altering the size of internal bonds located between subchambers.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sole structure for an article of footwear, the sole structure comprising:

a first barrier portion including a first surface;

a second barrier portion including a second surface that opposes the first surface, the second barrier portion joined to the first barrier portion to form a chamber enclosing a fluid between the first surface and the second surface and including a sidewall surrounding an outer perimeter of the chamber;

first substantially parallel bonds that extend in a direction between a medial side of the sole structure and a lateral side of the sole structure and join the first surface of the first barrier portion and the second surface of the second barrier portion, the first bonds each including a first end that is spaced apart from the sidewall at the medial side, a second end that is spaced apart from the sidewall at the lateral side, and a central portion extending between the first end and the second end and having a width in a first direction extending substantially parallel to a longitudinal axis of the sole structure that is less than a width of each of the first end and the second end in the first direction extending substantially parallel to the longitudinal axis of the sole structure, the first bonds defining a first plane and extending continuously and uninterrupted along the central portion between the first end and the second end across a majority of a width of the sole structure;

second substantially parallel bonds that extend in the direction between the medial side of the sole structure and the lateral side of the sole structure and join the first surface of the first barrier portion and the second surface of the second barrier portion, the second bonds each including a first end that is spaced apart from the sidewall at the medial side and a second end that is spaced apart from the sidewall at the lateral side;

first indentations formed by the second barrier portion extending in a direction toward the first barrier portion, the first indentations extending from the first end of respective ones of the first bonds toward the sidewall and increasing in width in a direction from the first end toward the sidewall at the first plane; and second indentations formed by the second barrier portion extending in a direction toward the first barrier portion, the second indentations extending from the second end of respective ones of the first bonds toward the sidewall and increasing in width in a direction from the second end toward the sidewall at the first plane;

wherein the first bonds alternate with the second bonds along a length of the chamber between a heel region of the chamber and a forefoot region of the chamber.

2. The sole structure of claim 1, wherein the first indentations and the second indentations extend to the sidewall.

3. The sole structure of claim 1, wherein the sidewall forms an outer surface of the sole structure.

4. The sole structure of claim 3, wherein the indentations form corresponding indentations in the outer surface of the sole structure.

5. The sole structure of claim 1, wherein the second surface of the second barrier portion is spaced apart from the first barrier portion at the first indentations and at the second indentations.

6. The sole structure of claim 1, further comprising a plurality of elongate subchambers that extend between the medial side of the sole structure and the lateral side of the sole structure, the subchambers being defined by one of the first bonds and one of the second bonds.

7. The sole structure of claim 6, wherein a size of the subchambers decreases in a direction from a heel region of the sole structure to a forefoot region of the sole structure.

8. The sole structure of claim 1, wherein the first bonds, the first indentations, and the second indentations cooperate to form recesses that extend continuously from the medial side of the sole structure to the lateral side of the sole structure.

9. A sole structure for an article of footwear, the sole structure comprising:

a first barrier portion including a first surface;

a second barrier portion including a second surface that opposes the first surface, the second barrier portion joined to the first barrier portion to form a chamber enclosing a fluid between the first surface and the second surface and including a sidewall surrounding an outer perimeter of the chamber and forming an outer surface of the sole structure;

first substantially parallel bonds that extend in a direction between a medial side of the sole structure and a lateral side of the sole structure and join the first surface of the first barrier portion and the second surface of the second barrier portion, the first bonds each including a first end that is spaced apart from the sidewall at the medial side, a second end that is spaced apart from the sidewall at the lateral side, and a central portion extending between the first end and the second end and having a width in a first direction extending substantially parallel to a longitudinal axis of the sole structure that is less than a width of each of the first end and the second end in the first direction extending substantially parallel to the longitudinal axis of the sole structure, the first bonds extending continuously and uninterrupted along the central portion from the first end to the second end across a majority of a width of the sole structure;

second substantially parallel bonds that extend in the direction between the medial side of the sole structure and the lateral side of the sole structure and join the first surface of the first barrier portion and the second surface of the second barrier portion, the second bonds each including a first end that is spaced apart from the sidewall at the medial side and a second end that is spaced apart from the sidewall at the lateral side;

first indentations formed by the second barrier portion extending in a direction toward the first barrier portion, the first indentations extending from the first end of respective ones of the first bonds to the sidewall to form corresponding indentations in the outer surface of the sole structure; and second indentations formed by the second barrier portion extending in a direction toward the first barrier portion, the second indentations extending from the second end of respective ones of the first bonds to the sidewall to form corresponding indentations in the outer surface of the sole structure;

wherein the first bonds alternate with the second bonds along a length of the chamber between a heel region of the chamber and a forefoot region of the chamber.

10. The sole structure of claim 9, wherein the first indentations increase in width in a direction from the first end toward the sidewall.

11. The sole structure of claim 10, wherein the second indentations increase in width in a direction from the second end toward the sidewall.

12. The sole structure of claim 9, further comprising an outsole attached to the second barrier portion on an opposite side of the second barrier portion than the second surface.

13. The sole structure of claim 12, wherein the outsole extends into the first indentations and into the second indentations.

14. The sole structure of claim 9, wherein the second surface of the second barrier portion is spaced apart from the first barrier portion at the first indentations and at the second indentations.

15. The sole structure of claim 9, further comprising a plurality of elongate subchambers that extend between the medial side of the sole structure and the lateral side of the sole structure, the subchambers being defined by one of the first bonds and one of the second bonds.

16. The sole structure of claim 9, wherein the first bonds, the first indentations, and the second indentations cooperate to form recesses that extend continuously from the medial side of the sole structure to the lateral side of the sole structure.

* * * * *